US008229340B2

(12) United States Patent
Shiozawa

(10) Patent No.: US 8,229,340 B2
(45) Date of Patent: Jul. 24, 2012

(54) CONTROL APPARATUS, PROGRAM, RECORDING MEDIUM, AND IMAGE FORMING SYSTEM

(75) Inventor: Motohide Shiozawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 188 days.

(21) Appl. No.: 12/695,626

(22) Filed: Jan. 28, 2010

(65) Prior Publication Data

US 2010/0196023 A1 Aug. 5, 2010

(30) Foreign Application Priority Data

Jan. 30, 2009 (JP) ..... 2009-020243

(51) Int. Cl.
*G03G 15/20* (2006.01)
*G03G 15/00* (2006.01)

(52) U.S. Cl. ..... 399/341; 399/45

(58) Field of Classification Search ..... 399/39, 399/40, 341, 342, 45; 430/97
See application file for complete search history.

(56) References Cited

U.S. PATENT DOCUMENTS

| | | | | |
|---|---|---|---|---|
| 7,139,521 | B2 * | 11/2006 | Ng et al. | 399/341 |
| 7,236,734 | B2 * | 6/2007 | Ng et al. | 399/341 |
| 2006/0133870 | A1 * | 6/2006 | Ng et al. | 399/341 |

FOREIGN PATENT DOCUMENTS

| | | | |
|---|---|---|---|
| JP | 4-338984 | A | 11/1992 |
| JP | 2008-139589 | A | 6/2008 |

* cited by examiner

*Primary Examiner* — Sandra Brase
(74) *Attorney, Agent, or Firm* — Canon USA Inc. IP Division

(57) ABSTRACT

A control apparatus configured to control an image forming system, in forming a transparent image so as to cover color images fixed on a sheet, applies a transparent toner on an area on which an image can be formed and which is other than an area that a user desires to increase the glossiness thereof.

7 Claims, 20 Drawing Sheets

GLOSS COATED PAPER
(GLOSSINESS: 50%)
COLOR IMAGE DENSITY: 20%

GLOSS COATED PAPER
(GLOSSINESS: 50%)
COLOR IMAGE DENSITY: 100%

MAT COATED PAPER
(GLOSSINESS: 6%)
COLOR IMAGE DENSITY: 20%

MAT COATED PAPER
(GLOSSINESS: 6%)
COLOR IMAGE DENSITY: 100%

A

ROW NUMBER →

COLUMN NUMBER ↓

| | 1 | 2 | 3 | 4 | 5 | 6 | 7 | 8 | 9 | 10 |
|---|---|---|---|---|---|---|---|---|---|---|
| 1 | 0, | 0, | 0, | 0, | 0, | 0, | 0, | 0, | 0, | 0, |
| 2 | 25, | 25, | 25, | 25, | 25, | 25, | 25, | 25, | 25, | 25, |
| 3 | 50, | 50, | 50, | 50, | 50, | 50, | 50, | 50, | 50, | 50, |
| 4 | 100, | 100, | 100, | 100, | 100, | 100, | 100, | 100, | 100, | 100, |
| 5 | 100, | 100, | 100, | 100, | 100, | 100, | 100, | 100, | 100, | 100, |
| 6 | 100, | 100, | 100, | 100, | 75, | 75, | 75, | 75, | 75, | 75, |
| 7 | 100, | 100, | 100, | 100, | 75, | 75, | 75, | 75, | 75, | 75, |
| 8 | 100, | 100, | 75, | 75, | 75, | 75, | 50, | 50, | 50, | 50, |
| 9 | 100, | 100, | 75, | 75, | 75, | 75, | 50, | 50, | 50, | 50, |
| 10 | 100, | 100, | 75, | 75, | 50, | 50, | 50, | 50, | 50, | 50, |
| 11 | 100, | 100, | 75, | 75, | 50, | 50, | 25, | 25, | 25, | 25, |
| 12 | 100, | 100, | 75, | 75, | 75, | 75, | 75, | 75, | 100, | 100, |
| 13 | 100, | 100, | 75, | 75, | 75, | 75, | 75, | 75, | 100, | 100, |

(IMAGE DATA (%))

FIG.13A

APPLY TRANSPARENT TONER TO PORTION C

ROW NUMBER

| COLUMN NUMBER | 1 | 2 | 3 | 4 | 5 | 6 | 7 | 8 | 9 | 10 |
|---|---|---|---|---|---|---|---|---|---|---|
| 1 | 37, | 37, | 37, | 37, | 37, | 37, | 37, | 37, | 37, | 37, |
| 2 | 36, | 36, | 36, | 36, | 36, | 36, | 36, | 36, | 36, | 36, |
| 3 | 34, | 34, | 34, | 34, | 34, | 34, | 34, | 34, | 34, | 34, |
| 4 | 29, | 29, | 29, | 29, | 29, | 29, | 29, | 29, | 29, | 29, |
| 5 | 29, | 29, | 29, | 49, | 49, | 49, | 49, | 49, | 49, | 29, |
| 6 | 29, | 29, | 29, | 49, | 34, | 34, | 34, | 34, | 34, | 31, |
| 7 | 29, | 29, | 29, | 49, | 34, | 34, | 34, | 34, | 34, | 31, |
| 8 | 29, | 29, | 31, | 34, | 34, | 34, | 20, | 20, | 20, | 30, |
| 9 | 29, | 29, | 31, | 34, | 34, | 34, | 20, | 20, | 20, | 30, |
| 10 | 29, | 29, | 31, | 34, | 20, | 20, | 9, | 9, | 9, | 36, |
| 11 | 29, | 29, | 31, | 34, | 20, | 20, | 9, | 9, | 9, | 36, |
| 12 | 29, | 29, | 31, | 34, | 34, | 34, | 34, | 34, | 49, | 29, |
| 13 | 29, | 29, | 31, | 31, | 31, | 31, | 31, | 31, | 29, | 29, |

(GLOSSINESS (%))

FIG.13B

APPLY TRANSPARENT TONER TO PORTION B

ROW NUMBER

| COLUMN NUMBER | 1 | 2 | 3 | 4 | 5 | 6 | 7 | 8 | 9 | 10 |
|---|---|---|---|---|---|---|---|---|---|---|
| 1 | 6, | 6, | 6, | 6, | 6, | 6, | 6, | 6, | 6, | 6, |
| 2 | 9, | 9, | 9, | 9, | 9, | 9, | 9, | 9, | 9, | 9, |
| 3 | 25, | 25, | 25, | 25, | 25, | 25, | 25, | 25, | 25, | 25, |
| 4 | 49, | 49, | 49, | 49, | 49, | 49, | 49, | 49, | 49, | 49, |
| 5 | 49, | 49, | 49, | 29, | 29, | 29, | 29, | 29, | 29, | 49, |
| 6 | 49, | 49, | 49, | 29, | 31, | 31, | 31, | 31, | 31, | 34, |
| 7 | 49, | 49, | 49, | 29, | 31, | 31, | 31, | 31, | 31, | 34, |
| 8 | 49, | 49, | 34, | 31, | 31, | 31, | 30, | 30, | 30, | 20, |
| 9 | 49, | 49, | 34, | 31, | 31, | 31, | 30, | 30, | 30, | 20, |
| 10 | 49, | 49, | 34, | 31, | 30, | 30, | 36, | 36, | 36, | 9, |
| 11 | 49, | 49, | 34, | 31, | 30, | 30, | 36, | 36, | 36, | 9, |
| 12 | 49, | 49, | 34, | 31, | 31, | 31, | 31, | 31, | 29, | 49, |
| 13 | 49, | 49, | 34, | 34, | 34, | 34, | 34, | 34, | 49, | 49, |

(GLOSSINESS (%))

(EXAMPLE OF SYSTEM CONFIGURATION)

CONTROL APPARATUS, PROGRAM, RECORDING MEDIUM, AND IMAGE FORMING SYSTEM

BACKGROUND OF THE INVENTION

1. Field of the Invention

The present invention relates to a control apparatus configured to control an image forming system configured to form a color image and a transparent image on a sheet, a program that causes an information processing apparatus or an information processing system to operate as the control apparatus, a recording medium that records the program, and an image forming system.

2. Description of the Related Art

Recently, it is desired by the printing market to improve the quality of a print product by increasing the degree of glossiness of a designated area. More specifically, it is desired to raise the level of glossiness of a designated area to a level higher than the level of glossiness of other areas.

In order to meet the demand by the market, Japanese Patent Application Laid-Open No. 04-338984 discusses an image forming apparatus that uses a transparent toner. The image forming apparatus discussed in Japanese Patent Application Laid-Open No. 04-338984 forms a transparent toner on an area whose glossiness is to be increased.

More specifically, the image forming apparatus discussed in Japanese Patent Application Laid-Open No. 04-338984 serially applies color toners (e.g., yellow, magenta, cyan, and black color toners) and a transparent toner onto a sheet and then collectively fixes the color and transparent toners formed on the sheet. Accordingly, the image forming apparatus discussed in Japanese Patent Application Laid-Open No. 04-338984 can raise the level of glossiness of the designated area to a level higher than the level of glossiness of other areas.

While it is desired to improve the quality of a print product, it is also highly desired to increase the productivity of a print product. In order to increase the productivity of a print product, it is useful to increase the speed of conveying a sheet. If the speed of conveying a sheet is increased, the amount of heat that a conveyed sheet receives from a fixing device may decrease. If a sheet receives a small amount of heat, then it is necessary to reduce the amount of toner to be fixed on the sheet.

Accordingly, if color toners and a transparent toner are collectively fixed on a sheet as in the method discussed in Japanese Patent Application Laid-Open No. 04-338984, the amount of heat applied to a sheet is relatively small in relation to the total amount of toners. In this case, fixing failure may occur.

In order to solve the above-described problem, Japanese Patent Application Laid-Open No. 2008-139589 discusses a method for coping with a small amount of heat applied on a sheet, in forming a transparent toner on the entire surface of a sheet, by separately executing processing for fixing color toners and processing for fixing a transparent toner.

The image forming apparatus discussed in Japanese Patent Application Laid-Open No. 2008-139589 transfers and fixes color toners on a sheet before transferring and fixing a transparent toner on the sheet having the color toners fixed thereon. Accordingly, the image forming apparatus discussed in Japanese Patent Application Laid-Open No. 2008-139589 can reduce the amount of toner fixed on the sheet at a time.

As described above, if the amount of heat which the fixing device can apply on a sheet is small, it is useful to separately execute color toner fixing processing and transparent toner fixing processing. If any other fixing method is used, the amount of toner that can be collectively fixed on a sheet may decrease if the speed of conveying a sheet is increased.

On the other hand, the level of glossiness of a designated area cannot always be increased if a transparent toner is partially formed as discussed in Japanese Patent Application Laid-Open No. 4-338984 by using the method discussed in Japanese Patent Application Laid-Open No. 2008-139589.

More specifically, if a transparent toner is formed on a designated area, whose glossiness is to be increased, of a sheet having color toners fixed thereon and the formed transparent toner is fixed on the sheet, then the level of glossiness of the area on which the transparent toner is formed may decrease. To paraphrase this, it was found that if a transparent toner is formed on a designated area, whose glossiness is to be increased, of a sheet having a high-density image, such as a photographic image, and if the formed transparent toner is fixed after that, then the level of glossiness of the area on which the transparent toner is fixed may decrease.

In addition, if an image is formed on a high-glossiness sheet (a sheet having a high level of glossiness), such as a gloss coated paper, the level of glossiness of an area on which the transparent toner is fixed may decrease regardless of the density of color images. As a result, in the above-described cases, the conventional methods cannot raise the level of glossiness of a designated area.

SUMMARY OF THE INVENTION

The present invention is directed to a control apparatus, a program, a recording medium, and an image forming system capable of raising the level of glossiness of an area that a user desires to increase the level of glossiness thereof even when a density of a color image is high. In addition, the present invention is directed to a control apparatus, a program, a recording medium, and an image forming system capable of raising the level of glossiness of an area that a user desires to increase the level of glossiness thereof even when the level of glossiness of a sheet is high.

According to an aspect of the present invention, a control apparatus, which is configured to control an image forming system including a color image forming unit configured to form a color image on a sheet, a transparent image forming unit configured to form a transparent image on the sheet, a first fixing unit configured to fix color images formed on the sheet, and a second fixing unit configured to fix the transparent image formed on the sheet, includes an image data acquisition unit configured to acquire color image data corresponding to a color image to be formed on the sheet, an area acquisition unit configured to acquire information about an area, of the color image to be formed on the sheet, whose glossiness is to be partially and relatively increased, and a control unit configured, if a density of the color image to be formed on the sheet based on the color image data is equal to or higher than a predetermined threshold value, to control the color image forming unit to form the color image on the sheet based on the color image data, configured to control the first fixing unit to fix the color image formed on the sheet, and after executing the above-described control, configured to control the transparent image forming unit to form a transparent image on an area on which an image can be formed, which is other than the area acquired by the area acquisition unit, so as to cover the color image fixed by the first fixing unit on the sheet with the transparent image, and configured to control the second fixing unit to fix the transparent image formed on the sheet.

According to another aspect of the present invention, a control apparatus, which is configured to control an image forming system including a color image forming unit configured to form a color image on a sheet, a transparent image forming unit configured to form a transparent image on the sheet, a first fixing unit configured to fix color images formed on the sheet, and a second fixing unit configured to fix the transparent image formed on the sheet, includes a sheet information acquisition unit configured to acquire information about glossiness of a surface of the sheet on which an image is to be formed, an area acquisition unit configured to acquire information about an area, of the color image to be formed on the sheet, whose glossiness is to be partially and relatively increased, and a control unit configured, based on the information acquired by the sheet information acquisition unit, if the information about the glossiness of the surface of the sheet is equal to or higher than a predetermined threshold value, to control the color image forming unit to form the color image on the sheet based on the color image data, configured to control the first fixing unit to fix the color image formed on the sheet, and after executing the above-described control, configured to control the transparent image forming unit to form a transparent image on an area on which an image can be formed, which is other than the area acquired by the area acquisition unit, so as to cover the color image fixed by the first fixing unit on the sheet with the transparent image, and configured to control the second fixing unit to fix the transparent image formed on the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

FIGS. 13A and 13B each illustrate an example of a matrix describing a structure of the color image data, which illustrates a distribution of glossiness corresponding to the density distribution of the color image data illustrated in FIG. 12A.

DESCRIPTION OF THE EMBODIMENTS

Various exemplary embodiments, features, and aspects of the invention will be described in detail below with reference to the drawings.

In an exemplary embodiment of the present invention, the degree of glossiness, which refers to the level of glossiness, was measured by using a Portable Gloss Meter PG-1M of NIPPON DENSHOKU INDUSTRIES CO., LTD., in a measurement mode of 60-degree glossiness measurement mode complying with Japanese Industrial Standards (JIS) Z 8741 "Specular glossiness—Method of measurement".

In a first exemplary embodiment of the present invention, an MFP, which is an image forming apparatus, forms an image on a sheet. In the following description, the "image processing system" refers to an information processing system configured to generate image data to be used in printing by using a printer unit (image forming unit) (a printer unit 115 illustrated in FIG. 2).

In addition, the "image forming system" refers to an image processing system that includes a printer unit 115. Furthermore, in the following description, an "information processing apparatus" refers to an apparatus including a central processing unit (CPU) (an information processing circuit) and configured to operate based on a program.

Moreover, if an information processing apparatus configured to process an image according to a program, the information processing apparatus is referred to as an "image processing apparatus".

Figure 1:
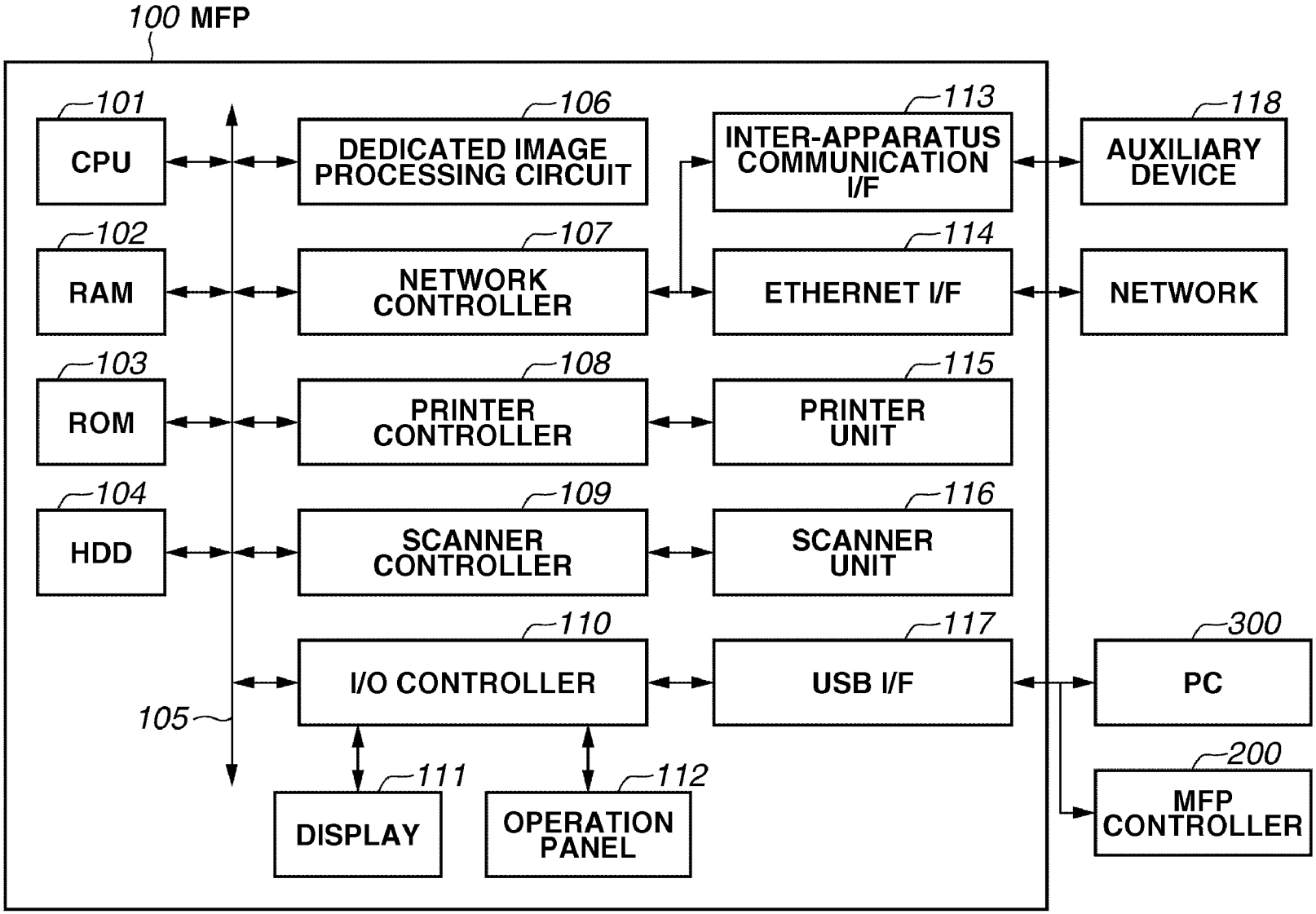
FIG. 1 illustrates an exemplary outline configuration of a multifunction peripheral (MFP) according to an exemplary embodiment of the present invention.

Now, an exemplary hardware configuration of the MFP, which is an example of the image forming apparatus, will be described in detail below with reference to FIG. 1. Referring to FIG. 1, an MFP 100 includes a controller unit, a scanner unit, and a printer unit. In addition, the present exemplary embodiment includes a transparent image forming apparatus as an auxiliary apparatus.

FIG. 1 illustrates an exemplary hardware configuration of the MFP 100. The MFP 100 includes a CPU 101, a random access memory (RAM) 102, and a read-only memory (ROM) 103, which are in communication with one another via a bus 105. Similarly, a hard disk drive (HDD) 104, a dedicated image processing circuit 106, a network controller 107, a printer controller 108, a scanner controller 109, and an input/output (I/O) controller 110 are in communication with one another via the bus 105. Thus, various units connected to the bus 105 can communicate with one another via the bus 105.

With the above-described configuration, the CPU 101 transmits a control command to the HDD 104, the network controller 107, the printer controller 108, the scanner controller 109, and the I/O controller 110 via the bus 105. In addition, the CPU 101 receives data, such as a status signal or image data, from the HDD 104, the network controller 107, the printer controller 108, the scanner controller 109, and the I/O controller 110 via the bus 105. As described above, the CPU 101 can control various units of the MFP 100.

The CPU 101 and the dedicated image processing circuit 106 loads and executes a program from the ROM 103 on a primary memory, i.e., a registry, which is provided within the CPU 101 and the dedicated image processing circuit 106.

When the CPU 101 or the dedicated image processing circuit 106 executes a program, the RAM 102 is sharedly utilized by the CPU 101 and the dedicated image processing circuit 106 as a secondary memory necessary. The HDD 104 has a recording capacity larger than that of the ROM 103. Accordingly, the HDD 104 is primarily utilized in storing image data to be stored within the MFP 100.

The network controller 107 is a processing circuit for executing communication with an external apparatus. The network controller 107 modulates a signal transmitted from the CPU 101 and converts the signal into a signal compliant with various applicable standards.

In the present exemplary embodiment, the network controller 107 converts a signal into a multivalued signal compliant with Institute of Electrical and Electronic Engineers (IEEE) 803.2 standard and transmits the multivalued signal to a network via an Ethernet interface (I/F) 114.

In addition, the network controller 107 demodulates the multivalued signal received from the network via the Ethernet I/F 114 and transmits the demodulated multivalued signal to the CPU 101.

With the above-described configuration, it is also useful if the MFP 100 communicates with an MFP controller 200 or a PC 300. Similarly, the network controller 107 converts a signal transmitted from the CPU 101 into a signal compliant with Attached Resource Computer NETwork (ARCNET) standard and transmits the converted signal to an auxiliary apparatus 118 via an auxiliary apparatus I/F 113.

In addition, the network controller 107 demodulates a signal received from the auxiliary apparatus 118 and transmits the demodulated signal to the CPU 101. In the present exemplary embodiment, the auxiliary apparatus 118 uses a transparent single-toner printer, which includes a transparent image forming station T, which forms a transparent image by forming a transparent toner on a sheet, and a fixing device. In addition, a finisher (post-processing apparatus) can be used as the auxiliary apparatus 118. Furthermore, a paper deck (auxiliary paper feed device) can be used.

The auxiliary apparatus according to the present exemplary embodiment uses the transparent single-toner printer as the transparent image forming apparatus. The transparent single-toner printer forms a transparent image on a sheet based on image data transmitted via ARCNET.

The CPU 101 transmits image data to a printer unit (image forming unit) 115 via the printer controller 108. Accordingly, if a page description language (PDL) has been input into the MFP 100 from the PC 300, then the CPU 101 and the dedicated image processing circuit 106 sharedly execute raster image processing (RIP).

The "PDL" is a programming language for instructing an image to be output to the MFP 100. It is useful to use the PDL because the PDL generally enables storage of graphic data as vector data independent of the resolution of a printer and reduction of the size of data of a simple line drawing to a size smaller than the size of image data.

However, if the PDL is used, it becomes necessary to convert PDL data into bitmap image data, which is necessary in outputting PDL data by using the printer unit. The PDL data conversion processing may incur overhead. The processing for converting PDL data into image data is called "RIP".

As described above, the image data generated by converting PDL data by RIP is transmitted to the printer unit 115 via the printer controller 108. The printer unit 115 outputs a print product based on the received image data.

The printer controller 108 controls the printer unit 115 to fix a toner image of image data onto a sheet based on externally input image data. Furthermore, the printer controller 108 controls the printer unit 115 based on image data transmitted from an external apparatus via a network.

In the present exemplary embodiment, if a transparent single-toner printer (the transparent image forming apparatus) is used as an auxiliary apparatus, the printer controller 108 transmits transparent image data to the transparent image forming apparatus via the network controller 107.

The scanner controller 109 controls a document image reading operation executed by an image sensor, which is provided below a document positioning plate of a scanner unit 116 and the operation of an auto document feeder (ADF). In reading image data of a document by using the MFP 100, a user sets the document on the document positioning plate sheet by sheet.

After receiving a user instruction for reading the document, the scanner controller 109 executes control for scanning the document with the image sensor, which is provided below the document positioning plate as described above, to acquire image data of the document set on the document positioning plate.

Furthermore, the user can set a plurality of documents on the ADF and give an instruction for automatically reading an image of the document. In this case, the ADF feeds one sheet of the plurality of sheets of the document set thereon to the image sensor.

Then, the ADF feeds another sheet to the image sensor, which is one of the sheets of the document different from the sheet having been previously fed to the image sensor in the above-described manner. The ADF repeats the above-described document sheet feeding operation until all the sheets of the document set thereon are completely fed.

In the above-described manner, the MFP 100 can serially and automatically read images of the plurality of sheets of the document set thereon. Accordingly, in scanning a document including a large number of sheets, the present exemplary embodiment can save the user's trouble of setting the sheets of the document on the ADF one after another by executing an operation for setting a document sheet for a large number of times.

If the user has selected a "box mode", which is an operation mode for storing an image on the HDD 104 of the MFP 100, then the scanner controller 109 stores the image data on the HDD 104, which has been acquired by the scanner unit 116.

If a "copy mode", which is an operation mode for outputting the image data acquired by the scanner unit 116 by using the printer unit 115, is selected, then the scanner controller 109 transmits the image data acquired by the scanner unit 116 to the printer controller 108.

In the above-described manner, the printer controller 108 executes control for outputting the received image data by using the printer unit 115.

The I/O controller 110 is a controller for communicating with the PC 300 or the MFP controller 200 via a universal serial bus (USB) I/F 117. In addition, the I/O controller 110 is connected to a display 111 and an operation panel 112.

The CPU 101 can acquire, via the I/O controller 110, information input by the user via the operation panel 112. In addition, the I/O controller 110 displays information used for designating a setting and information about a state of the MFP 100 on the display 111.

The display 111 displays a screen for inputting information about the glossiness of a sheet, which is used by the MFP 100. In addition, the display 111 displays a screen for designating an area whose glossiness is to be partially and relatively increased by using a transparent toner.

Figure 2:
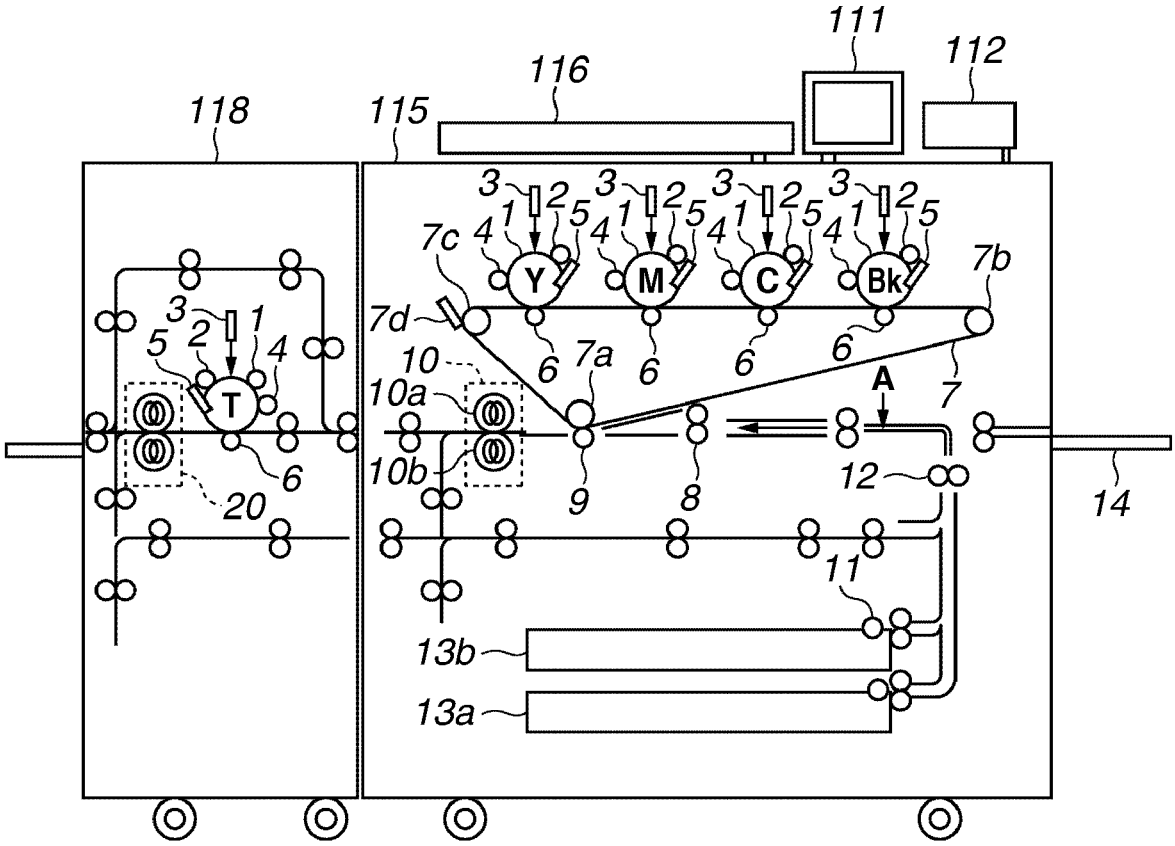
FIG. 2 illustrates an example of an MFP according to an exemplary embodiment of the present invention.

The scanner unit 116 is provided at a location above the sheet set on the printer unit 115 as illustrated in FIG. 2. As described above, the scanner unit 116 includes an image sensor (photoelectric conversion element) for reading an image of a document, the document positioning plate, and the ADF.

The scanner unit 116 acquires image data of the document set on the document positioning plate or the ADF by using the image sensor. The image data acquired by the scanner unit 116 is transmitted to the scanner controller 109. The scanner controller 109 can transmit the image data acquired by the scanner unit 116 to each of the above-described units and components connected one another via the bus 105.

Now, an exemplary configuration of the printer unit 115 according to the present exemplary embodiment will be described in detail below with reference to FIG. 2.

FIG. 2 illustrates an exemplary configuration of the MFP 100 according to the present exemplary embodiment including the printer unit 115, which is an electrophotographic type printer. The printer unit 115 includes a conveyance unit, an image forming unit, and a fixing unit.
includes Now, each of the conveyance unit, the image forming unit, and the fixing unit will be described in detail below.

The conveyance unit includes cassettes 13*a* and 13*b*, a manual feed tray 14, a pickup roller 11, a conveyance roller pair 12, and a registration roller pair 8. A sheet (a recording material) is set in the cassettes 13*a* and 13*b*. The glossiness, the grammage, and the type of the sheet set in the cassettes 13*a* and 13*b* can be manually registered via the operation panel 112.

The sheet set in the cassette 13*a* is conveyed to a secondary transfer unit in the following manner.

The sheets set in the cassette 13*a* are fed by the pickup roller 11 sheet by sheet. The sheet fed by the pickup roller 11 is then conveyed by the conveyance roller pair 12. Then, the sheet conveyed by the conveyance roller pair 12 contacts the registration roller pair 8, which is in an idle state at this timing.

The sheet that has contacted the registration roller pair 8 is then conveyed, to the secondary transfer unit, by the registration roller pair 8, which is now driven and rotated in synchronization with the toner image that has been transferred on an intermediate transfer belt 7.

The image forming unit includes an image forming station for each color and an intermediate transfer belt unit. An image forming station Y, which is configured to form a yellow toner, includes a photosensitive drum 1, an electric charging device 2, a laser scanner 3, a development unit 4, a primary transfer roller 6, and a drum cleaner 5. With respect to other colors, the image forming station includes a configuration substantially similar to that of the image forming station Y except the color of the toner contained in the development unit 4.

The intermediate transfer belt unit includes the intermediate transfer belt 7, a driven roller 7*a*, a secondary transfer counter roller 7*b*, and a driving roller 7*c*.

Now, an exemplary configuration of the image forming unit will be described in detail below with reference to an exemplary flow of processing for forming a toner image to be transferred on a sheet on the intermediate transfer belt 7.

A yellow toner image is formed by the image forming station Y. Similarly, a magenta toner image, a cyan toner image, and a black toner image are formed by an image forming station M, an image forming station C, and an image forming station Bk, respectively. The image forming stations Y, M, C, and Bk are arranged in substantially horizontal tandem with one another.

The toner images formed by the image forming stations Y through Bk are primarily transferred to the intermediate transfer belt 7, respectively. The toner image primarily transferred on the intermediate transfer belt 7 is secondarily transferred by the secondary transfer unit to the sheet.

The image forming stations Y through Bk have substantially the same configuration. Accordingly, hereinbelow, the image forming station Y, which is configured to form a yellow toner image, will be described in detail below as a representative image forming station.

The image forming station T includes the photosensitive drum 1, the charging roller 2, the laser scanner 3, the development unit 4, and the drum cleaner 5. The photosensitive drum (image bearing member) 1, which has a shape of a drum, is rotatably supported by the body of the MFP 100. The charging roller 2, the laser scanner 3, and the development unit 4 are provided around the photosensitive drum 1. The surface of the photosensitive drum 1 is evenly charged to a predetermined potential by the charging roller 2.

When an image signal for forming a yellow toner image is input from the printer controller 108 to the laser scanner 3, then the laser scanner 3 irradiates the surface of the photosensitive drum 1 with a laser beam based on the input image signal. Thus, the charge of the surface of the photosensitive drum 1 is neutralized and an electrostatic latent image is formed on the surface of the photosensitive drum 1.

Then, the electrostatic latent image formed on the surface of the photosensitive drum 1 is developed by the development unit 4 by using the transparent toner.

The yellow toner image developed on the photosensitive drum 1 is then primarily transferred by the primary transfer roller 6, which is provided at a location opposite to the photosensitive drum 1 across the intermediate transfer belt 7, onto the intermediate transfer belt (image conveyance member) 7. Transfer residual toners that have not been transferred onto the intermediate transfer belt 7 and remaining on the photosensitive drum 1 are collected by the drum cleaner 5.

In the image forming station Y, a yellow toner image is transferred onto the intermediate transfer belt 7 in the above-described manner. Similarly, toner images formed by the other image forming stations M, C, and BK are primarily transferred onto the intermediate transfer belt 7, respectively.

The intermediate transfer belt 7 is stretched around the driven roller 7*a*, the secondary transfer counter roller 7*b*, and the driving roller 7*c*. The driven roller 7*a* also serves as a tension roller. The driven roller 7*a* rotates in synchronization with the travel of the intermediate transfer belt 7 while applying tension to the intermediate transfer belt 7.

The secondary transfer counter roller 7*b* is provided at a location opposite a secondary transfer roller 9 across the intermediate transfer belt 7. In addition, during the secondary transfer, a secondary transfer bias voltage is applied by a high voltage power supply (not illustrated) to the secondary transfer counter roller 7*b*.

The driving roller 7*c* rotates based on a driving force from a driving motor (not illustrated). The intermediate transfer belt 7, which is stretched around the driving roller 7*c*, is driven by a driving force from the driving roller 7*c*.

The toner image formed on the intermediate transfer belt 7 by the image forming stations Y through Bk in the above-described manner is then conveyed to the secondary transfer unit. The toner image conveyed by the intermediate transfer belt 7 is transferred when a transfer bias is applied by the secondary transfer roller 9 and the driving roller 7*c* to the sheet that has been conveyed to the secondary transfer unit.

Transfer residual toners, which have not been transferred on the sheet by the secondary transfer unit and thus remaining on the intermediate transfer belt 7, are collected by a belt cleaner 7*d*. The belt cleaner 7*d* is provided on the downstream of the secondary transfer unit. In the present exemplary embodiment, a toner image is transferred on the sheet in the above-described manner. The sheet having the toner image transferred thereon is conveyed to the fixing unit. The fixing unit includes a fixing device 10.

Now, an example of a configuration of the fixing unit will be described in detail below with reference to an exemplary flow of processing for fixing the toner image that has been transferred on the sheet.

The fixing device 10 includes a fixing roller 10*a* and a pressure roller 10*b*. The fixing roller 10*a* and the pressure roller 10*b* are in pressure contact with each other. A fixing nip is formed between the fixing roller 10*a* and the pressure roller 10*b*.

In the present exemplary embodiment, the outer diameter of each of the fixing roller 10*a* and the pressure roller 10*b* is 80 mm. In addition, the length of each of the fixing roller 10*a* and the pressure roller 10*b* is 350 mm in the direction of the rotational axis. The fixing roller 10*a* is pivotably provided around an outer peripheral surface of the fixing device. The pressure roller 10*b* is in pressure contact against the fixing roller 10*a* by a spring (not illustrated) with a force of 500 N.

The fixing roller 10*a* is a layered member. More specifically, the fixing roller 10*a* includes an aluminum hollow core and a rubber layer (elastic layer) and a fluorine resin layer (toner release layer), which are laminated around the hollow core. A halogen heater (a heat source) is provided inside the hollow core. The hollow core can be made of a material other than aluminum, such as iron. It is also useful if the heat source is excluded and substituted by an induction heating (IH) method by utilizing electromagnetic induction heating. The fixing roller 10*a* is connected to the driving motor via an array of driving gears. The fixing roller 10*a* rotates by a rotational force from the driving motor.

The pressure roller 10*b* is a layered member similar to the fixing roller 10*a*. More specifically, the pressure roller 10*b* includes a hollow core and a rubber layer (elastic layer) and a fluorine resin layer (toner release layer), which are laminated around the hollow core. A halogen heater (a heat source) is provided inside the hollow core. The pressure roller 10*b* is driven and rotated by the fixing roller 10*a*.

A thermistor is mounted at a location close to the surface of each of the fixing roller 10*a* and the pressure roller 10*b* to detect the temperature thereof. Each corresponding thermistor can detect the temperature of the fixing roller 10*a* or the pressure roller 10*b*.

A signal indicating a detected temperature, which is output from the thermistor, is notified to the printer controller 108. With the above-described configuration, the printer controller 108 can control the temperature of each of the fixing roller 10*a* and the pressure roller 10*b*.

In the present exemplary embodiment, the printer controller 108 controls each halogen heater so that the temperature of the fixing roller 10*a* at the location close to the surface thereof becomes 155° C. and that the temperature of the pressure roller 10*b* at the location close to the surface thereof becomes 100° C.

Under the above-described fixing condition, the sheet having the toner image having been transferred thereon by the secondary transfer unit passes through the fixing nip. In the above-described manner, the toner image transferred on the sheet is fixed. The sheet having the toner image fixed thereon is discharged to the outside of the device via the conveyance path.

The present exemplary embodiment includes the transparent image forming apparatus as the auxiliary apparatus. Accordingly, the sheet having color images fixed thereon by the fixing device 10 is transmitted to the transparent image forming apparatus.

In the present exemplary embodiment, immediately after passing through the fixing nip generated on the fixing device 10, the sheet is separated from the fixing device 10 in a state in which the temperature of the sheet is kept at a high temperature ranging from approximately 90° C. to 110° C. The temperature of the sheet at the timing of separation from the fixing device 10 is necessarily affected by the fixing condition and the grammage of the sheet.

In the present exemplary embodiment, the fixing device 10 according to the present exemplary embodiment includes a roller pair including the fixing roller 10*a* and the pressure roller 10*b*. However, it is also useful if either of both of the fixing roller 10*a* and the pressure roller 10*b* is constituted by an endless belt. Furthermore, it is also useful if a fixing method different from that described above is used.

Now, the transparent single-toner printer, which is the transparent image forming apparatus according to the present exemplary embodiment, will be described in detail below.

The transparent single-toner printer includes the transparent image forming station T and a fixing device 20. The transparent image station T has a configuration substantially similar to that of the color image forming station Y included in the printer unit of the MFP 100. In addition, in the present exemplary embodiment, the fixing device 20 of the transparent single-toner printer has a configuration substantially similar to that of the fixing device 10 included in the printer unit. Furthermore, a control temperature and a processing speed of the fixing device 20 are substantially similar to those of the fixing device 10.

The transparent image forming station T includes a photosensitive drum 1, a charging device 2, a laser scanner 3, a development unit 4, a transfer roller 6, and a drum cleaner 5.

The surface of the photosensitive drum 1 is evenly charged by the charging device 2. The laser scanner 3 executes exposure on the photosensitive drum 1 so that an input toner image is formed on the photosensitive drum 1, which has been evenly charged. Thus, an electrostatic latent image is formed on the surface of the photosensitive drum 1.

After the electrostatic latent image is formed on the photosensitive drum 1, the development unit 4 transfers a transparent toner on the photosensitive drum 1. Thus, a transparent toner image is developed on the photosensitive drum 1. The transparent toner image formed on the photosensitive drum 1 is transferred by the transfer roller 6 on the sheet having the color images fixed thereon. The drum cleaner 5 cleans the photosensitive drum 1 by removing transfer residual toners, which have not been transferred on the sheet and thus remain on the surface of the photosensitive drum 1. In the above-described manner, a transparent toner image is transferred on the sheet having color images fixed thereon.

After the transparent toner is transferred on the sheet so as to cover the color images fixed thereon, the sheet is conveyed to the fixing device 20. The fixing device 20 fixes the transparent image formed on the sheet conveyed thereto on the sheet.

In the present exemplary embodiment, in forming the transparent image, the transparent single-toner printer forms and fixes the transparent image, which has been formed by using the transparent toner, on the sheet. On the other hand, if no transparent image is to be formed, the transparent single-toner printer discharges the sheet to the outside thereof via a corresponding conveyance path instead of conveying the sheet to the transparent image forming station T.

Now, the toner contained in the development unit 4 of each image forming station will be described in detail below.

In the present exemplary embodiment, a polyester resin is used as a material of each of the transparent toner and the color toners. The transparent toner and the color toners can be manufactured by crushing or by a method for directly preparing toners in a medium (polymerization), such as suspension polymerization, surface polymerization, or distributed polymerization. In the present exemplary embodiment, toners manufactured by using the suspension polymerization method were used as the transparent toner and the color toners. Components of the toners and the toner manufacturing method are not limited to those described above.

In the present exemplary embodiment, "color toners" collectively include the yellow toner, the cyan toner, the magenta toner, and the black toner, but does not include the transparent toner. A color toner is primarily made of a polyester resin and a pigment. A transparent toner is primarily made of a polyester resin.

A glass transition point (Tg) of each of the transparent toner and the color toners used in the present exemplary embodiment was about 55° C., respectively. In the present exemplary embodiment, the transparent toner was manufactured so that the transparent toner has a glass transition point (Tg) substantially equal to that of the color toner.

Therefore, if substantially the same amount of toner is applied in each unitary area under the same fixing condition, then the degree of glossiness of the transparent toner fixed on the sheet becomes substantially equal to the degree of glossiness of the color toner fixed on the sheet. However, the glass transition point (Tg) of each toner is not limited to the above-described glass transition point. If the type or the molecular weight of the resin used in the toner is changed, fusion characteristics of the toner may vary.

A "high glossiness paper" refers to a sheet on which the degree of glossiness of an area, on which a toner is fixed by one fixing operation by a fixing device, may become lower than the degree of glossiness of the entire sheet. On the other hand, a "low glossiness paper" refers to a sheet on which the degree of glossiness of an area, on which a toner is fixed by one fixing operation by a fixing device, may become higher than the degree of glossiness of the entire sheet. Whether a sheet is a high glossiness paper (or a low glossiness paper) is determined based on the type of the toner, the fixing condition, and the processing speed of the fixing device.

In the present exemplary embodiment, after the printer unit has formed and fixed the color images on the sheet, the auxiliary apparatus (transparent single-toner printer) 118 forms and fixes the transparent toner on the sheet having the color images formed and fixed thereon.

Now, an exemplary relationship between the amount of toner and the degree of glossiness when the toner is formed and fixed on a low glossiness paper will be described. In addition, an exemplary relationship between the amount of toner and the degree of glossiness when the toner is formed and fixed on a high glossiness paper will also be described.

Figure 3:
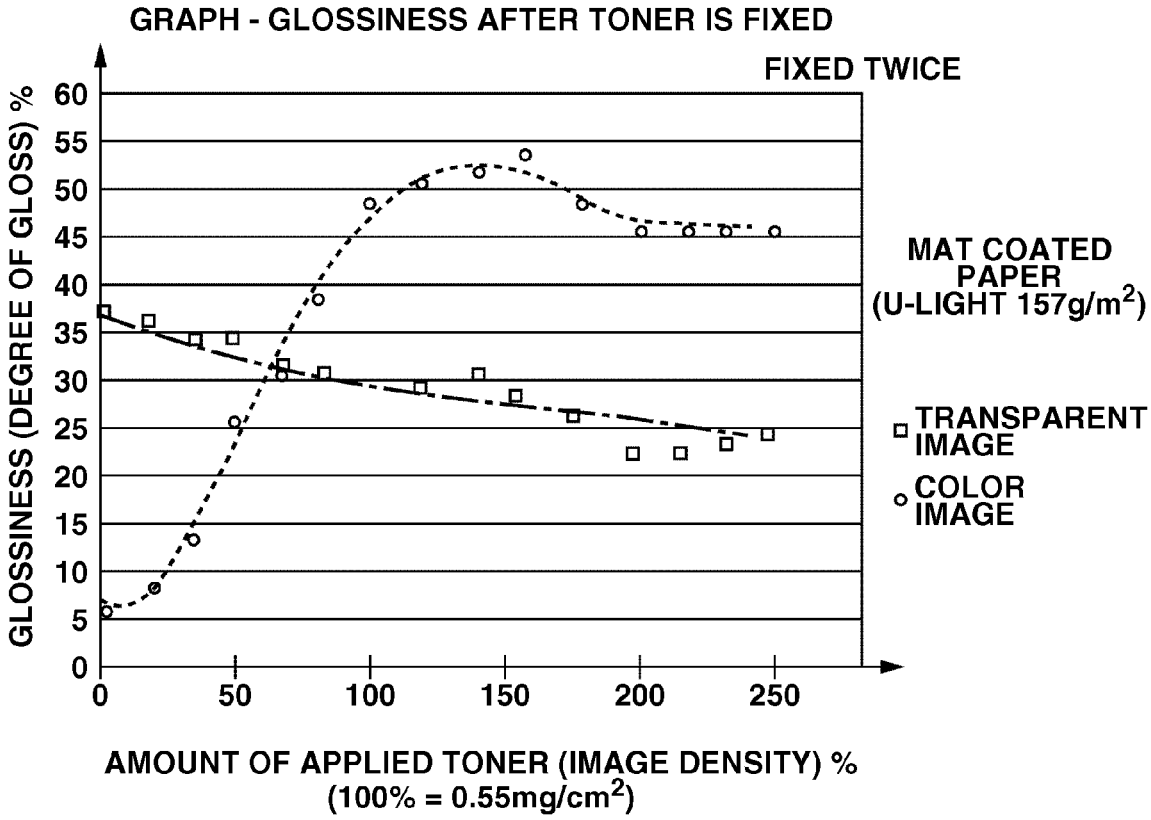
FIG. 3 illustrates an example of a relationship between the degree of glossiness of a low glossiness paper and a change of the amount of applied toner.

FIG. 3 is a graph illustrating an exemplary relationship between the amount of toner fixed in a unitary area of the surface of a sheet and the degree of glossiness of the toner image fixed on the sheet. In the example illustrated in FIG. 3, a mat coated paper "U-Light" (trademark) (grammage: 157 $g/m^2$) was used as the sheet (the low glossiness paper).

Referring to FIG. 3, the degree of glossiness at the angle of incidence of 60° C. is taken on the vertical axis of the graph of FIG. 3 while the toner amount is taken on the horizontal axis thereof. In the example illustrated in FIG. 3, the toner amount is described by a value calculated and determined in relation to a maximum amount (0.55 $mg/cm^2$ (100%)) of each toner applied on a unitary area.

In FIG. 3, the degree of glossiness of the area of the mat coated paper on which the color toner has been formed, fixed by the fixing device 10, and heated again by the fixing device 20 is indicated with a broken line. Furthermore, the degree of glossiness of the area of the mat coated paper on which the color toner has been formed and then fixed by the fixing device 10 and on which the transparent toner of the 70% toner amount (0.39 $mg/cm^2$) has been formed and fixed so as to cover the color toner fixed on the area is indicated with alternate long and short dashed line.

In the example illustrated in FIG. 3, at the 150% toner amount, the color toner is formed on the sheet at the toner amount of 150%. The toner formed on the sheet is fixed by the fixing device 10. The degree of glossiness of an area on which no transparent toner is formed is 51% because the area having no transparent toner formed thereon is heated again by the fixing device 20. In addition, the fixing device 20 fixes the transparent toner on the sheet on the area on which the 70% amount of transparent toner is formed so as to cover the color toners. The degree of glossiness of this area is 29%.

The curve indicated with the alternate long and short dashed line in FIG. 3 describes that the constant amount of 70% of transparent toner (0.39 $mg/cm^2$) is formed on the sheet. Accordingly, the curve indicated with the broken line describes that at the toner amount of 0% on the horizontal axis, the degree of glossiness of the sheet having no color toner or transparent toner is 6%. On the other hand, the curve indicated with the alternate long and short dashed line indicates the degree of glossiness of the area of the sheet on which the 70% amount of transparent toner is formed.

On the area on which no transparent toner covering the color toners is formed (i.e., the case indicated with the broken line), the fixing device has applied heat to the surface of the color toners twice. On the other hand, on the area on which the transparent toner is formed so as to cover the color toners (i.e., the case indicated with the alternate long and short dashed line), the fixing device has applied heat to the transparent toner, which is the top toner layer, only once. Therefore, the degree of glossiness of the area coated with the transparent toner may not be easy to be raised to a high degree.

The graph illustrated in FIG. 3 was achieved under the following conditions. More specifically, the processing speed of the fixing device was set at 250 mm/sec. In addition, the control target temperature of the fixing roller of the fixing device 10 was set at 155° C. while the temperature of the fixing roller of the fixing device 20 was also set at 155° C.

Figure 4:
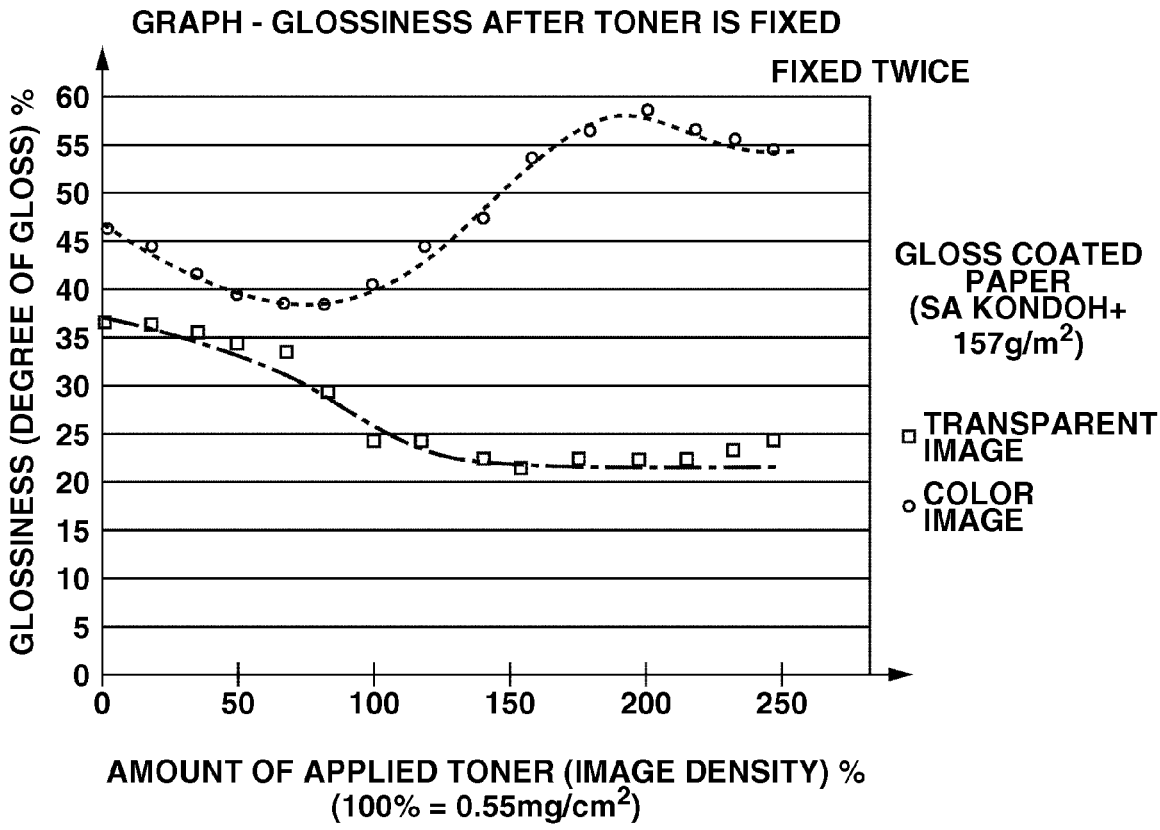
FIG. 4 illustrates an example of a relationship between the degree of glossiness of a high glossiness paper and a change of the amount of applied toner.

FIG. 4 is a graph illustrating an exemplary relationship between the amount of toner fixed on the surface of the sheet in a unitary area and the degree of glossiness of the toner image fixed on the sheet.

In the example illustrated in FIG. 4, a gloss coated paper (high glossiness paper) "SA Kondoh +" (trademark) (gramage: 157 g/m$^2$) was used as the sheet.

Referring to FIG. 4, the degree of glossiness at the angle of incidence of 60° C. is taken on the vertical axis of the graph of FIG. 4 while the toner amount is taken on the horizontal axis thereof. In the example illustrated in FIG. 4, the toner amount is described by a value calculated and determined in relation to a maximum amount (0.55 mg/cm$^2$ (100%)) of each toner applied on a unitary area.

In FIG. 4, the degree of glossiness of the area of the gloss coated paper on which the color toner has been formed, fixed by the fixing device 10, and heated again by the fixing device 20 is indicated with a broken line. Furthermore, the degree of glossiness of the area of the gloss coated paper on which the color toner has been formed and then fixed by the fixing device 10 and on which the transparent toner of the 70% toner amount (0.39 mg/cm$^2$) has been formed and fixed so as to cover the color toner fixed on the area is indicated with alternate long and short dashed line.

In the example illustrated in FIG. 4, at the 150% toner amount, the color toner is formed on the sheet at the toner amount of 150%. The toner formed on the sheet is fixed by the fixing device 10. The degree of glossiness of an area on which no transparent toner is formed is 47% because the area having no transparent toner formed thereon is heated again by the fixing device 20. In addition, the fixing device 20 fixes the transparent toner on the sheet on the area on which the 70% amount of transparent toner is formed so as to cover the color toners. The degree of glossiness of this area is 22%.

The curve indicated with the alternate long and short dashed line in FIG. 4 describes that the constant amount of 70% of transparent toner (0.39 mg/cm$^2$) is formed on the sheet. Accordingly, the curve indicated with the broken line describes that at the toner amount of 0% on the horizontal axis, the degree of glossiness of the sheet having no color toner or transparent toner is 47%. On the other hand, the curve indicated with the alternate long and short dashed line indicates the degree of glossiness of the area of the sheet on which the 70% amount of transparent toner is formed.

On the area on which no transparent toner covering the color toners is formed (i.e., the case indicated with the broken line), the fixing device has applied heat to the surface of the color toners twice. On the other hand, on the area on which the transparent toner is formed so as to cover the color toners (i.e., the case indicated with the alternate long and short dashed line), the fixing device has applied heat to the transparent toner, which is the top toner layer, only once. Therefore, the degree of glossiness of the area coated with the transparent toner may not be easy to be raised to a high degree.

The graph illustrated in FIG. 4 was achieved under the following conditions. More specifically, the processing speed of the fixing device was set at 250 mm/sec. In addition, the control target temperature of the fixing roller of the fixing device 10 was set at 155° C. while the temperature of the fixing roller of the fixing device 20 was also set at 155° C.

However, it is also useful if mutually different control target temperatures of the fixing device 10 and the fixing device 20 are used. The glass transition point temperatures Tg of the color toners and the transparent toner used in the present exemplary embodiment were 55° C. However, it is also useful if mutually different glass transition point temperatures Tg of the color toners and the transparent toner are used.

The degree of glossiness cannot be increased merely by forming the transparent toner on the area whose glossiness is to be increased by using the above-described device. Accordingly, the present exemplary embodiment controls the device according to the following flow chart to relatively raise the degree of glossiness of the area whose glossiness is to be increased, which is designated by the user.

The curves in the above-described graphs illustrating an example of the relationship between the toner amount and the degree of glossiness may vary according to the type of the sheet on which an image is to be formed, environmental conditions of the install location of the device, the type of the toner used to form the image, and the processing speed of the fixing device. Accordingly, information about the relationship between the toner amount and the degree of glossiness, which are used in executing the control, is stored within the MFP 100 as a lookup table (LUT).

Figure 9:
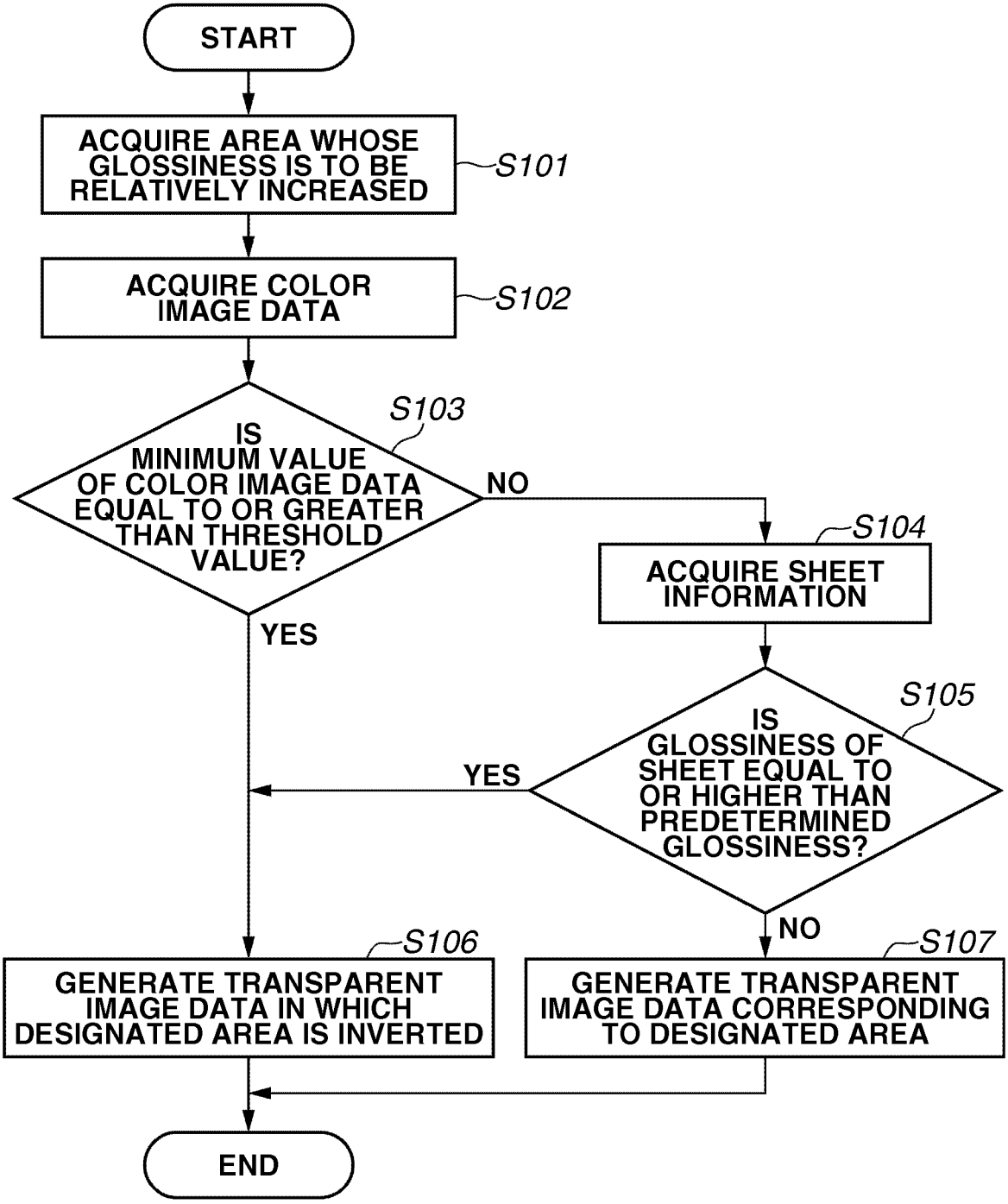
FIG. 9 is a flow chart illustrating an example of an operation of an MFP according to an exemplary embodiment of the present invention.

FIG. 9 is a flow chart illustrating an example of processing for controlling the MFP. In the present exemplary embodiment, processing for controlling the MFP and the transparent single-toner printer is executed by the CPU 101 of the MFP 100.

In the following description, an exemplary flow of processing will be described in detail below, which is executed by the CPU 101 for executing control for causing each of the components and units of the MFP (image forming system) 100 to execute an operation desired by the user according to a program stored on the ROM 103 with reference to the flow chart of FIG. 9.

In the present exemplary embodiment, image data to be used for forming a color image by using the printer unit (the image data is hereinafter referred to as "color image data") is generated by using a publicly known method. Accordingly, processing for executing image processing on color image data will not be described below.

In the following description, a screen for setting information used for the control by the MFP will be described in detail below first. Then, the control executed by the CPU (control apparatus) 101 for controlling the operation of the MFP and the transparent single-toner printer according to the information set via the setting screen will be described.

In order to increase the degree of glossiness of an area whose degree of glossiness is to be increased, which has been designated by the user, it is necessary for the MFP 100 to acquire information about an area that the user desires the degree of glossiness thereof to be partially increased.

In the following description, processing executed by the user for inputting, to the MFP 100, information about the glossiness of the sheet and information about an area that the user desires the degree of glossiness thereof to be partially increased will be described in detail.

In the following description, "information about the degree of glossiness of the sheet" and "information about an area that the user desires the degree of glossiness thereof to be partially increased" is collectively referred to as "transparent printing setting information. More specifically, the transparent printing setting information refers to information necessary to be set to print a transparent image.

The MFP 100 displays a screen illustrated in each of FIGS. 5 through 8 on the display 111 to acquire transparent printing setting information. Each of the screens is displayed and used in the following manner.

Figure 5:
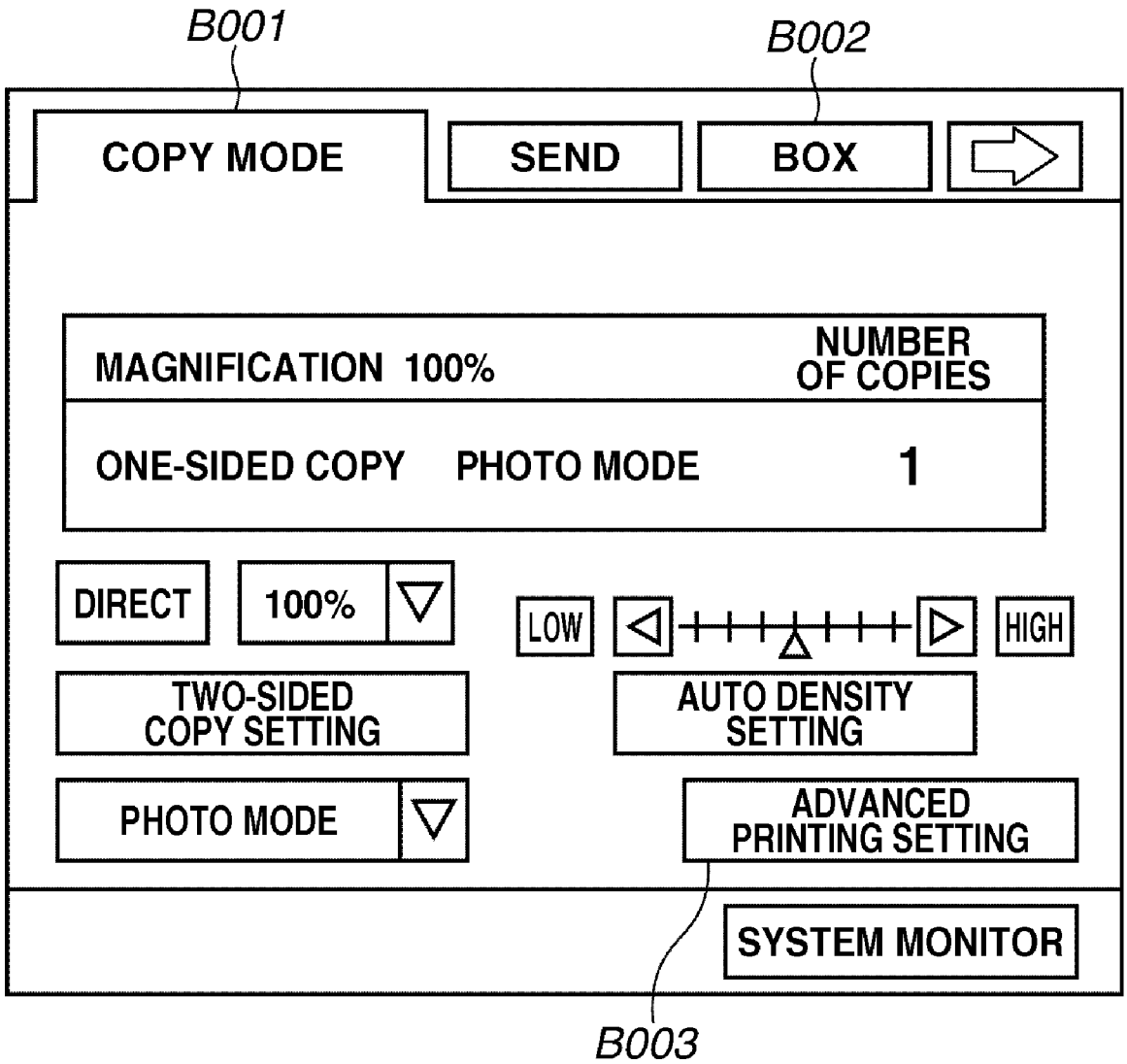
FIG. 5 is a flow chart illustrating an example of processing for controlling an image forming apparatus according to an exemplary embodiment of the present invention.

FIG. 5 illustrates an example of a screen displayed on the display 111. If the screen illustrated in FIG. 5 is currently displayed (the copy mode) on the display 111 and if the user has pressed a start button (not illustrated) in this state, then the MFP 100 starts processing for reproducing the document set on the document positioning plate. If a button B002 is selected, the operation mode of the MFP 100 is changed to a box mode.

In the box mode, the user can output data stored on the HDD of the MFP 100 by using the printer unit. If the user selects a button B001 in this state, the operation mode of the MFP 100 is changed from the box mode to the copy mode.

In the example illustrated in FIG. 5, the user can select an "advanced printing setting" button B003. If the user selects a "transparent printing setting" button (not illustrated) via an "advanced print setting" screen, then the MFP 100 displays a screen illustrated in FIG. 6 on the display 111.

Figure 6:
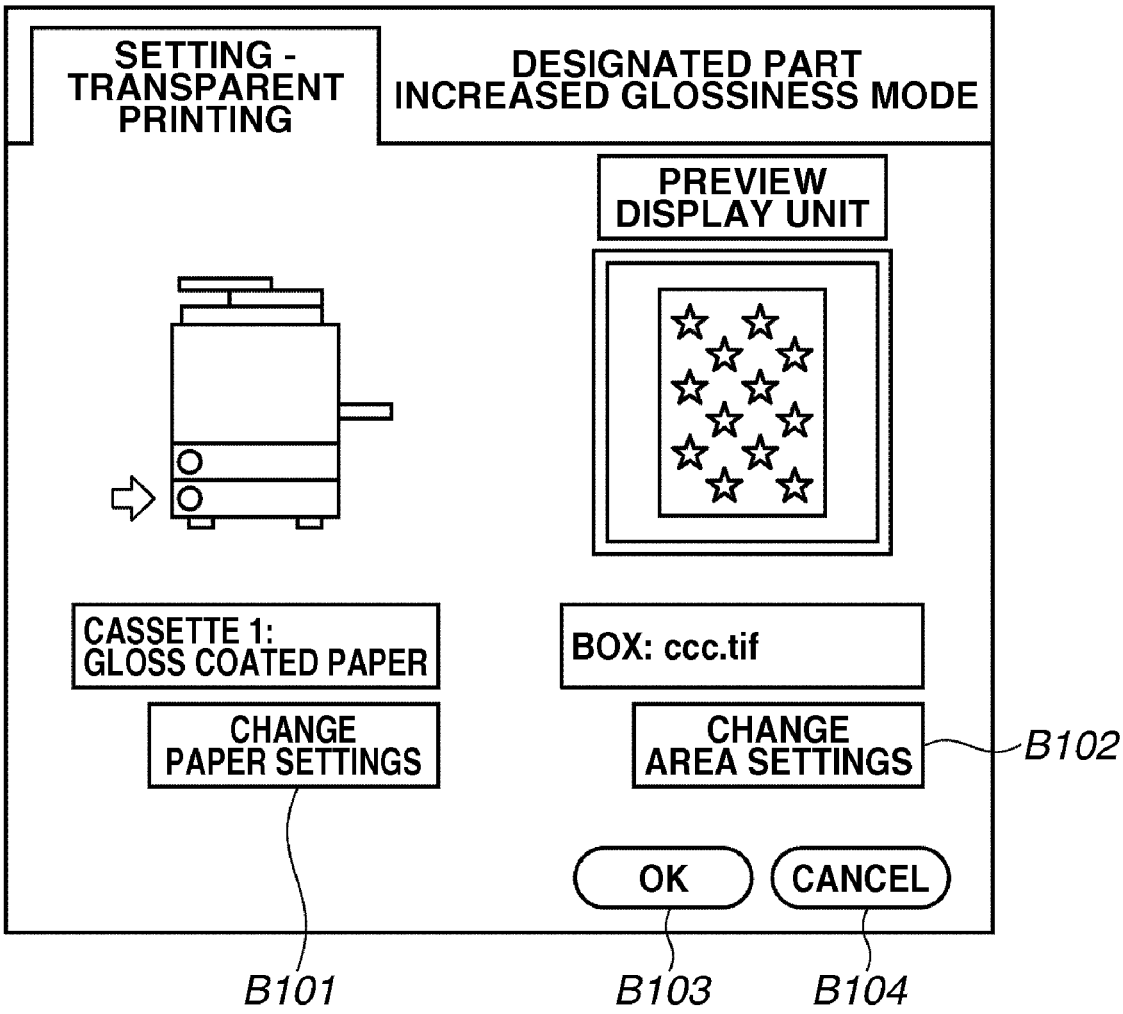
FIG. 6 illustrates an example of a screen displayed on a display of an MFP according to an exemplary embodiment of the present invention.

FIG. 6 illustrates an example of a screen for setting information necessary for printing executed by the MFP 100 by using the transparent toner. In executing transparent printing processing designated by the user, the MFP 100 displays the screen illustrated in FIG. 6 on the display 111 to prompt the user to enter transparent printing setting information.

If the user selects a button B101 included in the screen illustrated in FIG. 6, which is displayed on the display 111, then the MFP 100 executes control for displaying a screen (FIG. 7) for prompting the user to enter the information about the degree of glossiness of the sheet, which is the transparent printing setting information.

Similarly, if the user selects a button B102 of the screen illustrated in FIG. 6, which is displayed on the display 111, then the MFP 100 executes control for displaying a screen (FIG. 8) for prompting the user to enter the information about an area that the user desires the degree of glossiness thereof to be partially increased, which is the transparent printing setting information. In the present exemplary embodiment, the user can designate an area whose degree of glossiness is to be partially increased by using an image file. However, in designating an area whose degree of glossiness is to be partially increased, it is also useful if a different other method is used. In the above-described manner, the user can set the transparent printing setting information.

After setting the transparent printing setting information, the user can apply the transparent printing setting information by selecting a button B103 (an OK button). If the user has selected the button B103 (the OK button) in this state, then the MFP 100 displays the screen illustrated in FIG. 5 on the display 111.

In the above-described manner, the user can give an instruction for forming an image based on the transparent printing setting information set as described above by pressing the start button (not illustrated).

In addition, the user can discard the transparent printing setting information by selecting a button B104 (cancel button). If the user has selected the button B104 (the cancel button), then the MFP 100 displays the screen illustrated in FIG. 5 on the display 111.

Figure 7:
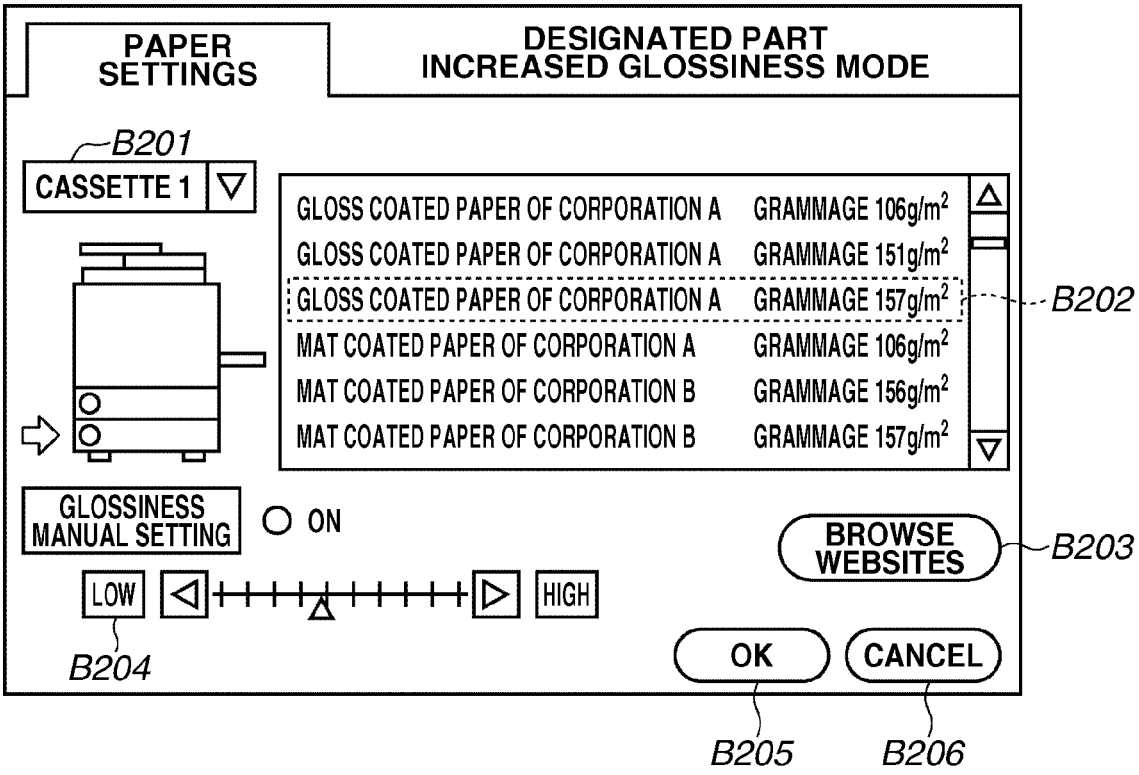
FIG. 7 illustrates an example of a screen displayed on a display of an MFP according to an exemplary embodiment of the present invention.

FIG. 7 illustrates an example of the screen via which the MFP 100 prompts the user to enter the information about the degree of glossiness of the sheet. Via the screen illustrated in FIG. 7, the user can select the cassette 13*a* (FIG. 2), the cassette 13*b* (FIG. 2), or the manual feed tray 14 (FIG. 2), in which the sheets to be used in printing are set.

If the user selects a button B201, items "cassette 1", "cassette 2", and "manual feed tray" are displayed on the display 111 as a pulldown menu to enable the user to select the source of feeding a sheet. However, the present invention is not limited to this. That is, it is also useful if a different other alternative presenting method, such as a pop-up menu, is used.

The user selects the item corresponding to the paper feed source cassette or tray in which the sheet to be used in printing has been set from among the items displayed and presented on the display 111. Suppose that the user has selected the item "cassette 1" as illustrated in FIG. 7. In this case, types of sheets that can be selected by the user are displayed on the display 111 as a list.

In the present exemplary embodiment, as described above, a sheet of the paper "SA Kondoh +" (grammage: 157 g/m$^2$) of Oji paper Co. Ltd. has been set in the "cassette 1" and a sheet of the paper "U-Light" (grammage: 157 g/m$^2$) of Nippon Paper Industries Co., Ltd. is set in the "cassette 2".

Accordingly, if the user has selected the item "cassette 1" from the pull-down menu of alternative items, then the CPU 101 execute control for moving a cursor B202 to an item "gloss coated paper of A Corporation (grammage: 157 g/m$^2$)", which corresponds to the paper "SA Kondoh +" (grammage: 157 g/m$^2$) of Oji paper Co. Ltd.

On the other hand, if the user has selected the item "cassette 2" from the pull-down menu of alternative items, then the CPU 101 execute control for moving a cursor B202 to an item "mat coated paper of B Corporation (grammage: 157 g/m$^2$)", which corresponds to the paper "U-Light" (grammage: 157 g/m$^2$) of Nippon Paper Industries Co., Ltd.

If the user has set a gloss coated paper of A Corporation (grammage: 157 g/m$^2$) in the cassette 1, then the user executes the following operations. At first, the user selects the cassette 1 (B201). Then, the user moves the cursor B202 to the item "gloss coated paper of A Corporation (grammage: 106 g/m$^2$)". By executing the above-described operation, the user can designate the type of the sheet to be printed on the MFP 100.

The MFP 100 holds, on the RAM 102, the following Table 1 that stores the type of sheets illustrated in FIG. 7. Accordingly, if the user has selected the item "gloss coated paper of A Corporation (grammage: 106 g/m$^2$)", then the CPU 101 can refer to the Table 1 and acquire the corresponding degree of glossiness of the sheet to be used in the printing "30%".

In addition, if the user has selected the item "mat coated paper of B Corporation (grammage: 157 g/m$^2$)", then the CPU 101 can refer to Table 1 and acquire the corresponding degree of glossiness of the sheet to be used in the printing "6%".

TABLE 1

| Company name | Type of paper | Grammage (g/m$^2$) | Glossiness degree (%) | Paper class |
|---|---|---|---|---|
| A Corp. | gloss coated paper | 106 | 30 | high gloss paper |
| A Corp. | gloss coated paper | 151 | 40 | high gloss paper |
| A Corp. | gloss coated paper | 157 | 50 | high gloss paper |
| A Corp. | mat coated paper | 106 | 10 | low gloss paper |
| B Corp. | mat coated paper | 156 | 9 | low gloss paper |
| B Corp. | mat coated paper | 157 | 6 | low gloss paper |

On the other hand, the type of the paper set in the cassette 1 may not be included in the list displayed on the display 111. In this case, the user can select a type of paper different from those presented and displayed on the display 111 by selecting a button B203. By selecting the button B203, the user can access a database that manages information about a sheet provided on the network.

The user selects the type of the sheet set in the cassette 1 from the database. In this manner, the user can select the paper of a type different from those included in the list.

In addition, the user can manually input a value of the glossiness of the sheet set in the cassette 1, the cassette 2, and the manual feed tray. In the example illustrated in FIG. 7, the user can set the information about the degree of glossiness of the sheet set in the corresponding cassette or tray by using a slider bar B204.

In setting the information about the degree of glossiness of the sheet by using the slider bar, the user can designate the sheet glossiness information at multiple stages as illustrated in FIG. 7. More specifically, in the example illustrated in FIG. 7, the user can set the degree of glossiness from 0 to 100% at ten different stages.

However, the method executed by the user for inputting information about the glossiness degree of the sheet is not limited to the slider bar. More specifically, if the user has set a high glossiness sheet, it is also useful if the user selects a button, which is selectably provided and displayed by the MFP 100 on the screen displayed on the display 111 to set the information about the degree of glossiness of the sheet.

As described above, the user can designate the information about the degree of glossiness of the sheet on the MFP 100, which is to be used for printing, by various methods.

In the present exemplary embodiment, the gloss coated paper of A Corporation (grammage: 157 g/m$^2$) set in the cassette 1 was used as the sheet to be used for printing, as illustrated in FIG. 7.

In order to apply the setting of the sheet to be used for printing, the user can select a button B205 (OK button). If the user presses the button B205, then the operation for executing the setting of the sheet to be used for printing ends. Then, the MFP 100 displays the screen illustrated in FIG. 6 on the display 111. The information set by the user in the above-described manner is stored on the RAM 102.

The information about the glossiness of the sheet stored on the RAM 102 in the above-described manner is acquired by the CPU 101 in step S104 in FIG. 9, which will be described below.

In addition, if the user does not desire to apply the setting of the sheet to be used for printing, the user can select a button B206 (cancel button). If the user presses the button B206, then the setting of the sheet used for printing is discarded. In this case, the MFP 100 then displays the screen illustrated in FIG. 6 on the display 111.

Figure 8:
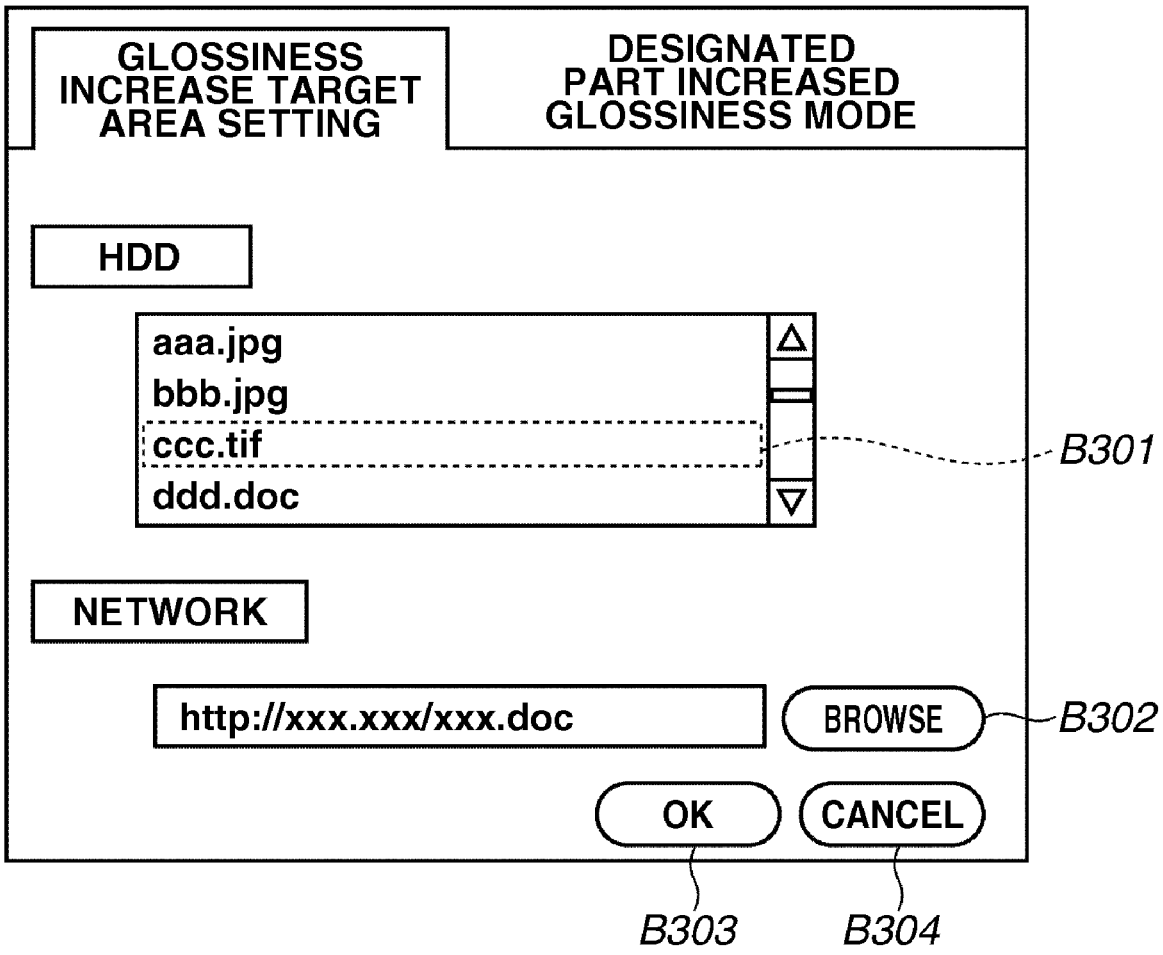
FIG. 8 illustrates an example of a screen displayed on a display of an MFP according to an exemplary embodiment of the present invention.

FIG. 8 illustrates an example of the screen for prompting the user to enter the information about an area that the user desires to partially increase the degree of glossiness thereof. In the example illustrated in FIG. 8, files stored on the HDD 104 provided within the MFP 100 are selectably displayed as a list. The user can designate a file corresponding to the area that the user desires to increase the degree of glossiness thereof to a relatively high level from among the files stored on the HDD 104.

In the present exemplary embodiment, it is supposed that the user has designated a file "ccc.tif" by moving a cursor B301 to a corresponding alternative included in the list of files.

In the above-described manner, the user can designate the area whose glossiness is to be increased by selecting an image displayed on the display 111. In the present exemplary embodiment, the image corresponding to the file "ccc.tif", which is illustrated in a preview display field in FIG. 6, is displayed.

Furthermore, in the present exemplary embodiment, each area of the preview image indicated with a solid black star illustrated in FIG. 6 corresponds to the area that the user desires to increase the degree of glossiness thereof. It is also useful if the user designates the area whose degree of glossiness is to be increased by using a file other than the file stored on the HDD 104.

More specifically, it is also useful if an area whose degree of glossiness is to be increased is designated by designating a file stored on an external apparatus via the Ethernet I/F 114. In this case, the user can designate a file other than the files stored on the HDD 104 by selecting a button B302 ("browse" button).

The method for designating an area is not limited to that described above. Although, in the present exemplary embodiment, the user designates the area whose degree of glossiness is to be increased by designating the file "ccc.tif", which is stored on the HDD 104, as illustrated in FIG. 8.

In order to apply the setting set in the above-described manner, the user can select a button B303 (OK button). If the user selects the button B303, the setting is applied. In this case, the MFP 100 then displays the screen illustrated in FIG. 6 on the display 111.

The information set by the user in the above-described manner is stored on the RAM 102. The information for designating the area whose degree of glossiness is to be increased, which is now stored on the RAM 102, is then acquired by the CPU 101 in step S101 of FIG. 9.

On the other hand, if the user does not desire to apply the setting, the user can select a button B304 (cancel button) to discard and cancel the setting. In this case, the MFP 100 then displays the screen illustrated in FIG. 6 on the display 111.

Various information is set in the above-described manner. However, the present exemplary embodiment is not limited to this. More specifically, it is also useful if the above-described transparent printing setting information is acquired by a method different from the method described above.

Figure 18:
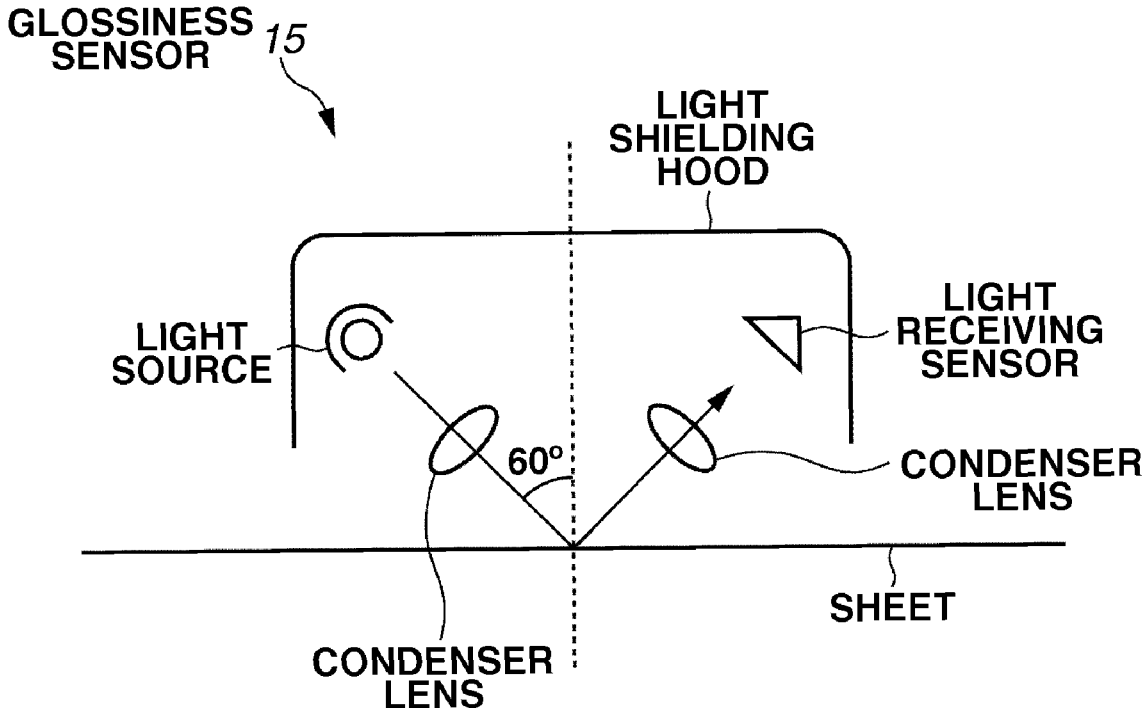
FIG. 18 illustrates an example of a glossiness sensor according to an exemplary embodiment of the present invention.

In addition, it is also useful if the information about the degree of glossiness of a sheet is acquired by using a glossiness sensor 15 provided within the MFP, as illustrated in FIG. 18. Furthermore, it is also useful if the area whose degree of glossiness is to be increased is acquired from the scanner unit 116. Moreover, it is also useful if an area designated by the user by using a digitizer is acquired and used.

Now, an operation of the MFP, which is executed based on the transparent printing setting information, will be described in detail below with reference to each of the following flow charts. FIG. 9 is a flow chart illustrating an example of the operation of each of the MFP and the transparent single-toner printer. The CPU 101 controls the MFP 100 according to a program stored on the ROM 103.

Referring to FIG. 9, step S101 corresponds to processing for acquiring the information about the area designated by the user, whose area glossiness is to be increased. In step S101, the CPU 101 acquires the information about the area whose degree of glossiness is to be increased, which has been designated by the user. The CPU 101 stores the acquired information about the area on the RAM 102.

Step S102 corresponds to processing for acquiring the information about the color image designated by the user. In step S102, the CPU 101 acquires the information about the color image designated by the user. The CPU 101 stores the acquired information about the color image on the RAM 102.

Step S103 corresponds to processing for determining an image for the transparent toner, which is generated based on the information about the color image acquired in step S102. More specifically, in step S103, the CPU 101 acquires a value of a maximum density included in the information about the color image acquired in step S102. In addition, the CPU 101 compares the acquired maximum density value with a predetermined threshold value.

If the maximum density value of the color image to be formed on the sheet is equal to or higher than the density value of 60%, which is the predetermined threshold value (YES in step S103), then the processing advances to step S106.

On the other hand, if the maximum density value of the color image to be formed on the sheet is less than the predetermined threshold value of 60% (NO in step S103), then the processing advances to step S104.

The predetermined threshold value may vary according to the type of the sheet, characteristics of the toner used in the printing, and the processing speed. Accordingly, it is also useful if the threshold value is changed according to the type of the sheet, characteristics of the toner used in the printing, and the processing speed.

Step S104 is a step for acquiring the information about the sheet. More specifically, in step S104, the CPU 101 acquires the degree of glossiness, which is information about the glossiness of the sheet on which an image is to be formed. The CPU 101 stores the acquired degree of glossiness on the RAM 102.

Step S105 is a step for determining image data used for forming an image by using the transparent toner, which is generated based on the degree of glossiness of the sheet having been acquired in step S104 (the image data is hereinafter referred to as "transparent image data"). More specifically, in step S105, the CPU 101 determines whether the degree of glossiness of the sheet is equal to or higher than a predetermined threshold value. In the present exemplary embodiment, the threshold value of glossiness degree is set at the degree of glossiness of 20%.

If it is determined that the degree of glossiness of the sheet acquired in step S104 is equal to or higher than a predetermined threshold value (YES in step S105), then the processing advances to step S106. On the other hand, if it is determined that the degree of glossiness of the sheet acquired in step S104 is less than a predetermined threshold value (NO in step S105), then the processing advances to step S107.

In the present exemplary embodiment, the glossiness degree of 20%, which is a boundary value used for determining whether a sheet is a high glossiness paper (or a low glossiness paper), is used as the predetermined threshold value. In the present exemplary embodiment, a glossiness degree value is used as the predetermined threshold value as described above. However, it is also useful if a substantially similar value other than that described above is used as the predetermined threshold value, instead.

In step S106, the CPU 101 executes processing for generating transparent image data. More specifically, the CPU 101 generates data for forming a transparent image on an area on which an image can be formed, except the area acquired in step S101.

The "area on which an image can be formed" will be particularly described. Some presently marketed printers have a so-called "bordered printing mode" and a "borderless printing mode". More specifically, if the bordered printing mode is selected, no image is formed in a marginal area of the sheet existing across a "border", which has a width of few millimeters from an edge of the sheet. To paraphrase this, if it is instructed to the printer to apply a toner on the entire surface of the sheet, no image is formed in a "margin" (a peripheral area of a sheet existing across the "border") of a resulting print product.

If the "bordered printing mode" is selected, the "area on which an image can be formed" refers to an area of the sheet except the margin. On the other hand, if the "borderless printing mode" is selected, the "area on which an image can be formed" refers to the entire surface of the sheet. The width of a margin can be appropriately and arbitrarily changed.

In step S107, the CPU 101 executes processing for generating transparent image data. More specifically, the CPU 101 generates data used for forming a transparent image on the area acquired in step S103.

The CPU 101 transmits the transparent image data used for forming the transparent image generated in step S106 or S107 to the transparent single-toner printer.

The printer unit of the MFP, which forms color images on the sheet by using the color toners, receives the color image data. Each of the color image forming stations, which forms color toner images on the sheet, forms color toners on the sheet based on the received image data. Then, the fixing device 10 executes fixing processing on the sheet.

In addition, the transparent single-toner printer transmits the received transparent image data to the transparent image forming station T. The transparent image forming station T forms the transparent image to cover the color image fixed on the sheet based on the received transparent image data.

The transparent single-toner printer receives the transparent image data generated in either of step S106 or step S107. After being formed by the transparent image forming station T on the sheet, the transparent toner is fixed on the sheet by the fixing device 20.

With the above-described configuration, the present exemplary embodiment can output a print product having the area designated by the user, whose degree of glossiness has been raised to a high level.

The present exemplary embodiment acquires and uses the density of color images formed on the sheet in the above-described manner. Accordingly, even when the density of the color images is high, the present exemplary embodiment can raise the degree of glossiness of the designated area to a relatively high level.

The sequence of the control executed by the MFP and the transparent single-toner printer is not limited to that described above with reference to FIG. 9. More specifically, it is also useful if the control executed by the MFP and the transparent single-toner printer is executed according to a processing flow illustrated in FIG. 11.

Figure 11:
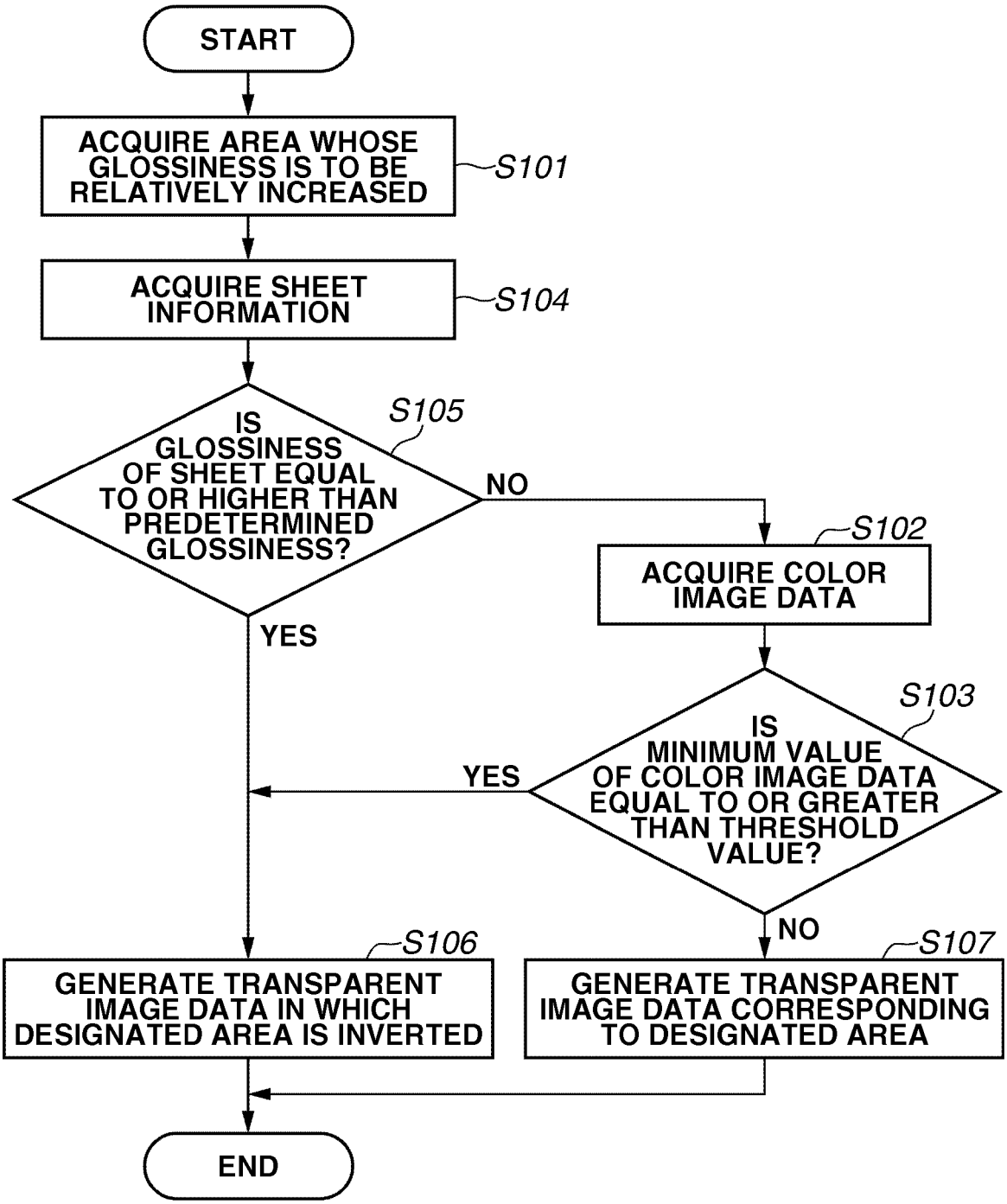
FIG. 11 is a flow chart illustrating an example of an operation of an MFP according to an exemplary embodiment of the present invention.

FIG. 11 is a flow chart illustrating an example of the operation of each of the MFP and the transparent single-toner printer. Referring to FIG. 11, before acquiring color image data, the CPU 101 acquires information about the sheet.

Accordingly, if the sheet on which an image is to be formed is a high glossiness paper, the present exemplary embodiment can generate transparent image data used for raising the degree of glossiness of the area designated by the user to a high level without determining the density of the color images.

As described above, the control sequence can be appropriately changed if the degree of glossiness of the designated area can be relatively raised to a high level.

Now, a print product output by controlling the MFP and the transparent single-toner printer according to the above-described processing flow will be described in detail.

FIGS. 10A through 10D schematically illustrate a print product output by the apparatus. In the present exemplary embodiment, the area that the user desires to increase the degree of glossiness thereof is hereafter referred to as a "marked area" while an area other than the area that the user desires to increase the degree of glossiness thereof is hereafter referred to as a "background area".

Figure 10A:
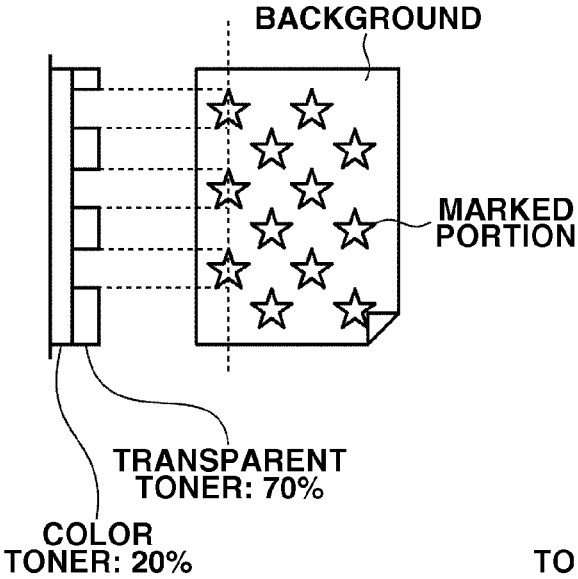
FIGS. 10A through 10D each illustrate an example of an image and a print product processed and output by the image processing apparatus according to an exemplary embodiment of the present invention.

In the example illustrated in FIG. 10A, it is supposed that the color images are evenly formed on the entire sheet surface with the 20% toner amount. It is also supposed that the degree of glossiness of the sheet on which the image is to be formed is 50% (i.e., the sheet is a high glossiness paper) and that the area whose degree of glossiness is to be increased corresponds to a file "aaa.tif". In this case, a print product illustrated in FIG. 10A is output.

Figure 10B:
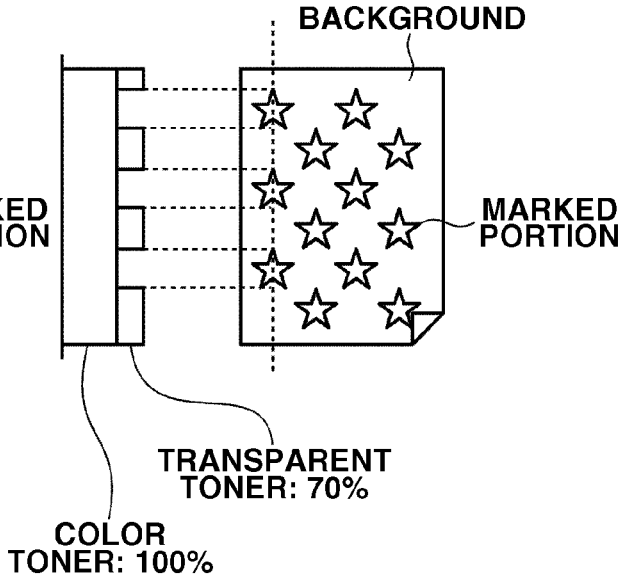

In the example illustrated in FIG. 10B, it is supposed that the color images are evenly formed on the entire sheet surface with the 100% toner amount. It is also supposed that the degree of glossiness of the sheet on which the image is to be formed is 50% (i.e., the sheet is a high glossiness paper) and that the area whose degree of glossiness is to be increased corresponds to a file "aaa.tif". In this case, a print product illustrated in FIG. 10B is output.

Figure 10C:
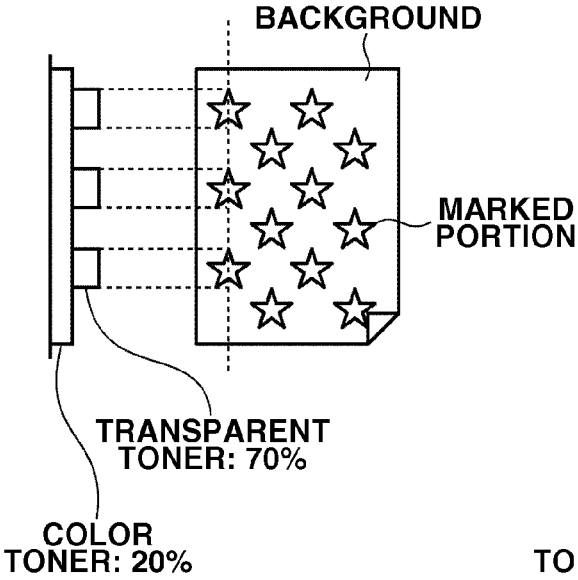

In the example illustrated in FIG. 10C, it is supposed that the color images are evenly formed on the entire sheet surface with the 20% toner amount. It is also supposed that the degree of glossiness of the sheet on which the image is to be formed is 6% (i.e., the sheet is a low glossiness paper) and that the area whose degree of glossiness is to be increased corresponds to a file "aaa.tif". In this case, a print product illustrated in FIG. 10C is output.

Figure 10D:
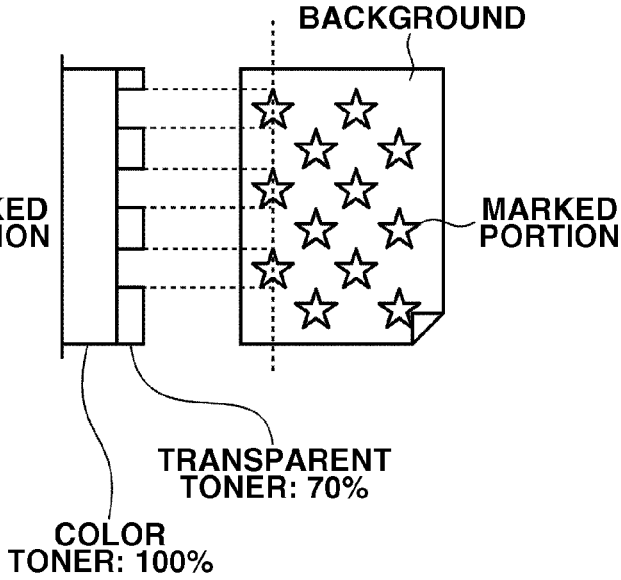

In the example illustrated in FIG. 10D, it is supposed that the color images are evenly formed on the entire sheet surface with the 100% toner amount. It is also supposed that the degree of glossiness of the sheet on which the image is to be formed is 6% (i.e., the sheet is a low glossiness paper) and that the area whose degree of glossiness is to be increased corresponds to a file "aaa.tif". In this case, a print product illustrated in FIG. 10D is output.

In each of the examples illustrated in FIGS. 10A through 10D, the transparent toner is evenly formed on the sheet so as to cover the color images with the 70% toner amount. In the present exemplary embodiment, the color toners and the transparent toner are evenly applied on the sheet in a unitary area for easier understanding. However, the present exemplary embodiment is not limited to this.

Now, a print product output in each of the following cases will be described in detail below with reference to a corresponding table.

TABLE 2

<Case of Forming Image on Gloss Coated Paper Sheet>

| | | Marked area | Background area |
|---|---|---|---|
| Image density signal (%) | Color image Density signal | 20% | 20% |
| | Transparent Image density signal | 0% | 70% |
| Unitary area toner amount | | 0.11 mg/cm$^2$ | 0.50 mg/cm$^2$ |
| Degree of glossiness at 60° angle of incidence | | 45% | 24% |

Table 2 describes the degree of glossiness of each of the marked area (the area illustrated in FIG. 10A with a star mark) and the background area of the print product output in the case of the example illustrated in FIG. 10A. Referring to Table 2, the degree of glossiness of the marked area of the gloss coated paper, on which the color toners are applied with the 20% toner amount, becomes 40%, while the degree of glossiness of the background area, on which the toners are applied with the total 90% toner amount, becomes 24%, based on the relationship illustrated in FIG. 4.

Accordingly, the degree of glossiness of 40% of the marked area becomes higher than the degree of glossiness of 24% of the background area. With the above-described configuration, the present exemplary embodiment can raise the degree of glossiness of a marked area of a gloss coated paper (high glossiness paper) to a level relatively higher than the degree of glossiness of the background area.

TABLE 3

| | | Marked area | Background area |
|---|---|---|---|
| Image density signal (%) | Color image Density signal | 100% | 100% |
| | Transparent Image density signal | 0% | 70% |
| Unitary area toner amount | | 0.55 mg/cm$^2$ | 0.94 mg/cm$^2$ |
| Degree of glossiness at 60° angle of incidence | | 41% | 23% |

Table 3 describes the degree of glossiness of each of the marked area (the area illustrated in FIG. 10B with a star mark) and the background area of the print product output in the case of the example illustrated in FIG. 10B. Referring to Table 3, the degree of glossiness of the marked area of the gloss coated paper, on which the color toners are applied with the 100% toner amount, becomes 41%, while the degree of glossiness of the background area, on which the toners are applied with the total 170% toner amount, becomes 23%, based on the relationship illustrated in FIG. 4.

Accordingly, the degree of glossiness of 41% of the marked area becomes higher than the degree of glossiness of 23% of the background area. With the above-described configuration, the present exemplary embodiment can raise the degree of glossiness of a marked area of a gloss coated paper (high glossiness paper) to a level relatively higher than the degree of glossiness of the background area.

TABLE 4

<Case of Forming Image on Mat Coated Paper Sheet>

| | | Marked area | Background area |
|---|---|---|---|
| Image density signal (%) | Color image Density signal | 20% | 20% |
| | Transparent Image density signal | 70% | 0% |
| Unitary area toner amount | | 0.50 mg/cm$^2$ | 0.11 mg/cm$^2$ |
| Degree of glossiness at 60° angle of incidence | | 36% | 8% |

Table 4 describes the degree of glossiness of each of the marked area (the area illustrated in FIG. 10C with a star mark) and the background area of the print product output in the case of the example illustrated in FIG. 10C. Referring to Table 4, the degree of glossiness of the marked area of the mat coated paper, on which the color toners are applied with the 90% toner amount, becomes 36%, while the degree of glossiness of the background area, on which the toners are applied with the 20% toner amount, becomes 8%, based on the relationship illustrated in FIG. 3.

Accordingly, the degree of glossiness of 36% of the marked area becomes higher than the degree of glossiness of 8% of the background area. With the above-described configuration, the present exemplary embodiment can raise the degree of glossiness of a marked area of a mat coated paper (low glossiness paper) to a level relatively higher than the degree of glossiness of the background area.

TABLE 5

| | | Marked area | Background area |
|---|---|---|---|
| Image density signal (%) | Color image Density signal | 100% | 100% |
| | Transparent Image density signal | 0% | 70% |
| Unitary area toner amount | | 0.55 mg/cm$^2$ | 0.94 mg/cm$^2$ |
| Degree of glossiness at 60° angle of incidence | | 47% | 30% |

Table 5 describes the degree of glossiness of each of the marked area (the area illustrated in FIG. 10D with a star mark) and the background area of the print product output in the case of the example illustrated in FIG. 10D. Referring to Table 5, the degree of glossiness of the marked area of the mat coated paper, on which the color toners are applied with the 100% toner amount, becomes 47%, while the degree of glossiness of the background area, on which the toners are applied with the 170% toner amount, becomes 30%, based on the relationship illustrated in FIG. 3.

Accordingly, the degree of glossiness of 47% of the marked area becomes higher than the degree of glossiness of 30% of the background area. With the above-described configuration, the present exemplary embodiment can raise the degree of glossiness of a marked area of a mat coated paper (low glossiness paper) to a level relatively higher than the degree of glossiness of the background area.

As described above, the present exemplary embodiment can raise the degree of the glossiness of the area that the user desires to raise the degree of glossiness thereof if the density of the color images is high. In addition, the present exemplary embodiment changes the area on which the transparent toner is to be formed according to the information about the sheet on which the color image is formed if the density of the color image is low. With the above-described configuration, the present exemplary embodiment can raise the degree of the glossiness of the area that the user desires to raise the degree of glossiness thereof.

In the above-described first exemplary embodiment, color images are formed on the entire surface of the sheet with a constant toner amount. In a second exemplary embodiment of the present invention, color images having a density distribution illustrated in 12A and 12B is formed on the sheet.

Units, components, and processing similar to the first exemplary embodiment are provided with the same numeral or symbol. Accordingly, the description thereof will not be repeated here.

Figures 12A, 12B:
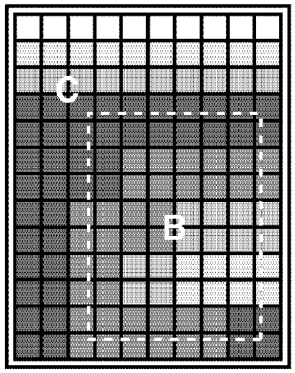
FIGS. 12A and 12B each illustrate an example of a density distribution of color image data and an exemplary matrix describing a structure of the color image data.

FIGS. 12A and 12B illustrate an exemplary density distribution of color image data. More specifically, FIG. 12A schematically illustrates an exemplary density of color image data. FIG. 12B schematically illustrates an exemplary matrix of the structure of the data with numerical values.

In the example illustrated in FIG. 12A, the entire area A includes areas B and C. The area B is an area whose degree of glossiness is to be increased. The area C is an area other than the area B whose degree of glossiness is to be increased.

If the density of the color image is distributed as illustrated in FIGS. 12A and 12B, the CPU 101 determines an area on which the transparent toner is to be formed. The CPU 101 converts the density distribution of the color image into the glossiness degree distribution to determine the area on which the transparent toner is to be formed.

More specifically, the degree of glossiness is converted according to the relationship between the toner amount and the degree of glossiness illustrated in FIGS. 3 and 4. In calculating the degree of glossiness according to the toner amount formed on the sheet, the CPU 101 calculates the degree of glossiness by using an LUT. It is also useful if the degree of glossiness is calculated by utilizing a polynomial of a curve calculated by polynomial approximation based on the data illustrated in FIGS. 3 and 4.

The CPU 101 calculates data corresponding to the distribution of glossiness achieved when the transparent toner is selectively formed on the area B based on the data corresponding to the density distribution of color image data. In addition, the CPU 101 calculates data corresponding to the distribution of glossiness achieved when the transparent toner is selectively formed on the area C based on the data corresponding to the density distribution of color image data.

FIG. 13A illustrates an exemplary glossiness distribution achieved when the transparent toner is formed on the area C with the density of 70%. In addition, FIG. 13B illustrates an exemplary distribution of glossiness achieved when the transparent toner is formed on the area B with the density of 70%.

The CPU 101 converts each matrix element of the color image density in the matrix illustrated in FIG. 12B into glossiness degree. In the above-described manner, the CPU 101 can calculate data of the distribution of the degree of glossiness achieved when the transparent toner is formed on the area B and data of the distribution of the degree of glossiness achieved when the transparent toner is formed on the area C.

The CPU 101 selectively forms the transparent toner on either one of the area B or the area C based on the color image density distribution illustrated in FIGS. 12A and 12B in the following manner. Now, an exemplary operation for determining the area on which the transparent toner is formed will be described in detail below with reference to the following flow charts. More specifically, an operation of the MFP executed when the color image has the density distribution illustrated in FIGS. 12A and 1B will be described in detail below with reference to flow charts illustrated in FIGS. 14 and 15.

Figure 14:
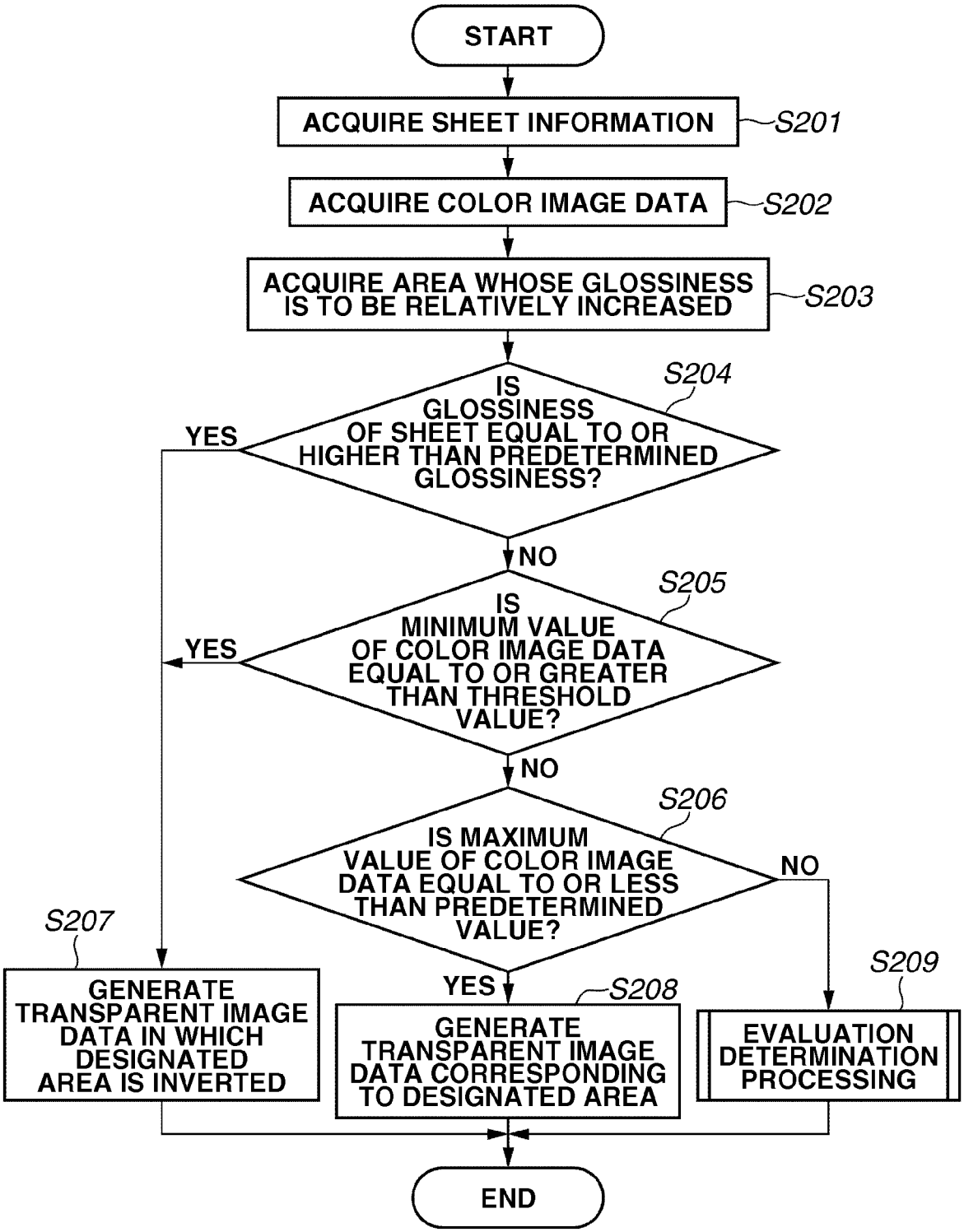
FIG. 14 is a flow chart illustrating an example of processing for controlling an image forming apparatus according to an exemplary embodiment of the present invention.
Figure 15:
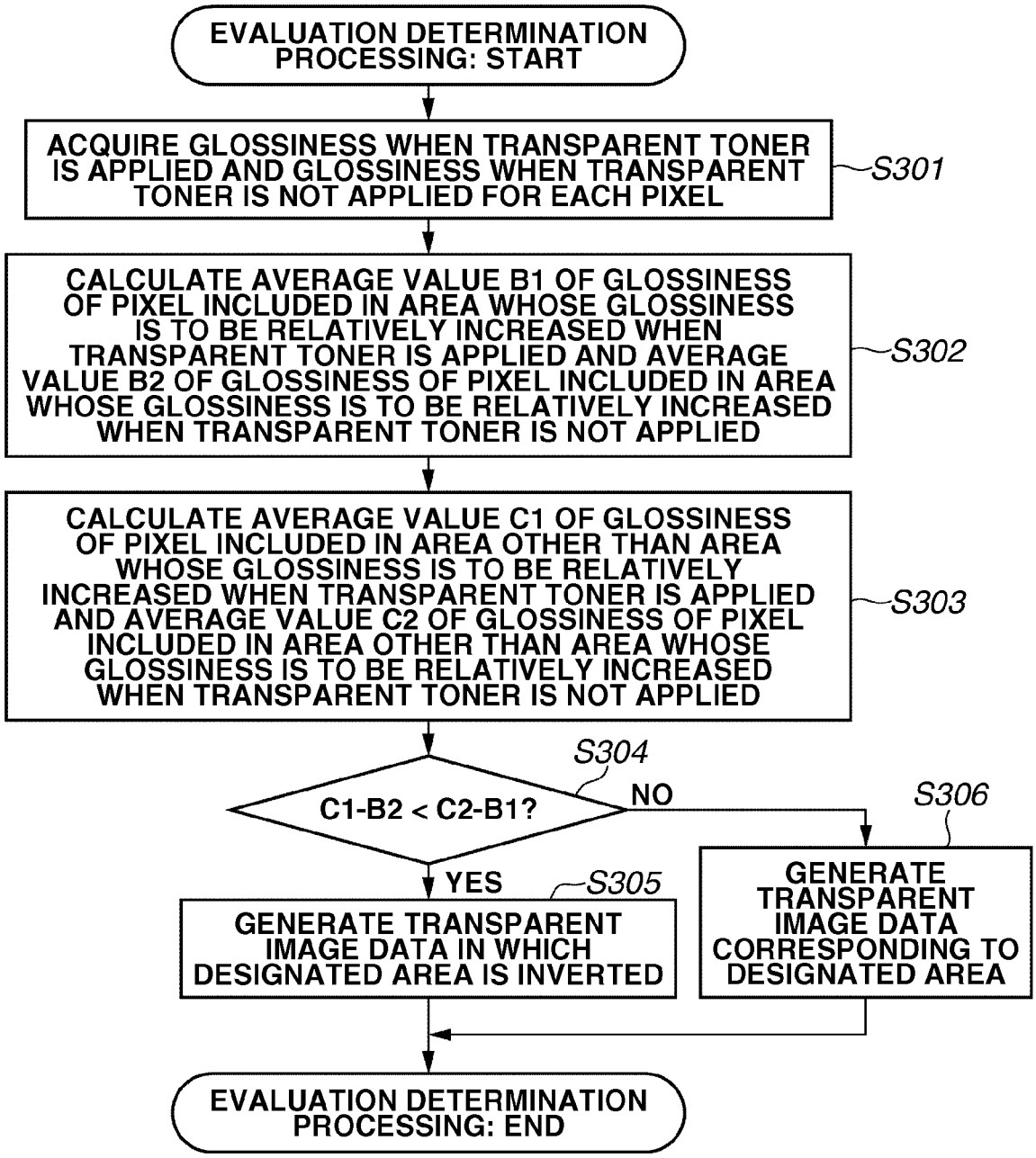
FIG. 15 is a flow chart illustrating an example of processing for controlling an image forming apparatus according to an exemplary embodiment of the present invention.

FIG. 14 is a flow chart illustrating an exemplary operation of the MFP. FIG. 15 is a flow chart illustrating an example of predefined processing executed in step S209 of FIG. 14. According to a program stored on the ROM 103, the CPU 101 executes control for causing the MFP 100 to operate according to the flow chart illustrated in FIG. 14.

In the present exemplary embodiment also, the information about the sheet and information about color image data and the area whose glossiness is to be increased are previously set as in the first exemplary embodiment.

Referring to FIG. 14, in step S201, the CPU 101 acquires information about the sheet. More specifically, the CPU 101 acquires the degree of glossiness, which is information corresponding to the glossiness of the sheet on which an image is formed. The CPU 101 stores the acquired glossiness degree on the RAM 102.

Step S202 corresponds to processing for acquiring the information about the color image designated by the user. More specifically, in step S202, the CPU 101 acquires the information about the color image designated by the user and stores the acquired information about the color image on the RAM 102.

Step S203 corresponds to processing for acquiring the information about the area whose glossiness is to be increased designated by the user. More specifically, in step S203, the CPU 101 acquires the information about the area whose glossiness is to be increased designated by the user and stores the acquired area on the RAM 102.

Step S204 corresponds to processing for determining image data (hereinafter simply referred to as "transparent image data") used for forming an image by using the transparent toner generated according to the degree of glossiness of the sheet, which has been acquired in step S201. More specifically, in step S204, the CPU 101 determines whether the glossiness degree of the sheet acquired in step S201 is equal to or higher than the 20% glossiness degree, which is a predetermined threshold value.

If it is determined that the glossiness degree of the sheet acquired in step S201 is equal to or higher than the 20% glossiness degree (YES in step S204), then the processing advances to step S207. On the other hand, if it is determined that the glossiness degree of the sheet acquired in step S201 is lower than the 20% glossiness degree (NO in step S204), then the processing advances to step S205.

In the present exemplary embodiment, the glossiness degree of 20%, which is a boundary value used for determining whether a sheet is a high glossiness paper (or a low glossiness paper), is used as the predetermined threshold value. In the present exemplary embodiment, a glossiness degree value is used as the predetermined threshold value as described above. However, it is also useful if a substantially similar value other than that described above is used as the predetermined threshold value, instead.

Step S205 corresponds to processing for determining an image for the transparent toner generated based on the information about the color image acquired in step S202. In step S205, the CPU 101 acquires a value indicating the minimum density included in the information (values of all pixels) about the color image acquired in step S202.

More specifically, in step S205, the CPU 101 determines whether the lowest value of color image data is equal to or higher than a predetermined threshold value (60%). If it is determined that the lowest value of color image data is equal to or higher than the predetermined threshold value (60%) (YES in step S205), then the processing advances to step S207. On the other hand, if it is determined that the lowest value of color image data is lower than the predetermined threshold value (60%) (NO in step S205), then the processing advances to step S206.

The predetermined threshold value may vary according to the type of the sheet, characteristics of the toner used in the printing, and the processing speed. Accordingly, it is also useful if the threshold value is changed according to the type of the sheet, characteristics of the toner used in the printing, and the processing speed.

Step S206 corresponds to processing for determining an image for the transparent toner generated based on the information about the color image acquired in step S202. In step S206, the CPU 101 acquires a value indicating the maximum density included in the information (values of all pixels) about the color image acquired in step S202 and compares the acquired value with a predetermined threshold value.

More specifically, in step S206, the CPU 101 determines whether the highest value of color image data is equal to or lower than a predetermined threshold value (60%). If it is determined that the highest value of color image data is equal to or lower than the predetermined threshold value (60%) (YES in step S206), then the processing advances to step S208. On the other hand, if it is determined that the highest value of color image data is higher than the predetermined threshold value (60%) (NO in step S206), then the processing advances to step S209.

In step S207, the CPU 101 executes processing for generating transparent image data. More specifically, CPU 101 generates the transparent image data for forming the transparent toner selectively on the area on which an image can be formed except the area acquired in step S203. The generated transparent image data is transmitted to the printer unit 115.

In step S208, the CPU 101 executes processing for generating transparent image data. More specifically, the CPU 101 generates transparent image data for forming the transparent toner on the area acquired in step S203. After the transparent image data generated in step S208 is received, the printer unit 115 outputs the sheet on which the transparent toner has been formed and fixed selectively on the area on which an image can be formed except the area acquired in step S203. Accordingly, the present exemplary embodiment can output a print product whose area designated by the user has a high glossiness even when a high glossiness paper is used.

Step S209 corresponds to processing for executing predefined processing. The processing in step S209 will be described in detail below with reference to FIG. 15.

Step S209 corresponds to processing for determining on which of the area B (the area acquired in step S203) and the area C (the area other than the area acquired in step S203) the transparent toner is to be selectively formed.

The CPU 101 transmits the transparent image data determined in steps S207 through S209 to the printer unit 115. The printer unit 115 forms the color toners on the sheet based on the received image data. Then, the sheet is fixed by the fixing device 10. Furthermore, the transparent single-toner printer transmits the received transparent image data to the transparent image forming station T. The transparent image forming station T, based on the received transparent image data, forms the transparent image so as to cover the fixed color image.

The transparent image data received by the transparent image forming station T is the transparent image data generated in either of steps S207, S208, S305 (FIG. 15), and S306 (FIG. 15). Then, the transparent toner formed on the sheet is fixed on the sheet by the fixing device 20. With the above-described configuration, the present exemplary embodiment can output a print product whose area designated by the user to increase the degree of glossiness has a high glossiness.

The predefined processing illustrated in FIG. 14 will be described in detail below with reference to the flow chart of FIG. 15. FIG. 15 is a flow chart illustrating a defined operation in step S209 of FIG. 14.

Each step of the processing flow of FIG. 15 will be described. In step S301, the CPU 101 converts the color image data into degree of glossiness. More specifically, the CPU 101 converts the density of each pixel of the color image data acquired in step S202 into degree of glossiness if the transparent toner has been fixed or not. In executing the above-described conversion, the CPU 101 uses the LUT stored on the ROM 102.

In step S302, the CPU 101 evaluates the degree of glossiness of each pixel of the area whose degree of glossiness is to be increased (the area B illustrated in FIG. 12A), which has been converted from the density of each pixel. Because a user recognizes a graphic by recognizing a boundary, it is useful to adjust a boundary of a graphic so that the difference between areas across the boundary of the graphic becomes great in order to enable a user to appropriately recognize a graphic based on glossiness difference. More specifically, data existing in the vicinity of a boundary is significant in determining the area on which the transparent toner is to be formed.

Accordingly, in the present exemplary embodiment, because data existing in the vicinity of a boundary is significant, weighted mean, whose weight around the boundary area is great, is used to calculate an evaluation value. Accordingly, the present exemplary embodiment can calculate an evaluation value, which is calculated based on significant data of the degree of glossiness of data existing in the vicinity of a boundary. With the above-described configuration, the present exemplary embodiment can generate a graphic whose image has unambiguous difference in degree of glossiness in areas existing across a boundary, which enables a user to easily recognize the graphic.

In calculating an evaluation value, it is also useful if a method other than the weighted mean, such as unweighted mean, is used. An "evaluation value" refers to a numeric value used in generating transparent image data. In the present exemplary embodiment, the evaluation value is used in the unit of glossiness degree.

The CPU 101 acquires data of the degree of glossiness of data existing in the vicinity of the boundary, of the area whose degree of glossiness is to be increased. In addition, the CPU 101 calculates an evaluation value based on the acquired data of the glossiness degree by using weighted mean.

More specifically, the CPU 101 calculates an evaluation value B1 used in the case of applying the transparent toner on the area B. The calculated evaluation value B1 is stored on the RAM 102. In addition, the CPU 101 calculates an evaluation value B2 used in the case of not applying the transparent toner on the area B. The calculated evaluation value B2 is also stored on the RAM 102.

Step S303 corresponds to processing for evaluating glossiness degree data of each pixel of the area other than the area whose degree of glossiness is to be increased (the area C illustrated in FIG. 12A), which has been converted from density data thereof. More specifically, the CPU 101 calculates an evaluation value of the degree of glossiness of data existing in the vicinity of the boundary, of the area other than the area whose degree of glossiness is to be increased (the area C illustrated in FIG. 12A), by using weighted mean.

More specifically, the CPU 101 calculates an evaluation value C1 used in the case of applying the transparent toner on the area C. The calculated evaluation value C1 is stored on the RAM 102. In addition, the CPU 101 calculates an evaluation value C2 used in the case of not applying the transparent toner on the area C. The calculated evaluation value C2 is also stored on the RAM 102.

Step S304 corresponds to processing for determining transparent image data used for increasing the degree of glossiness of the area whose glossiness is to be increased (the area B in FIG. 12A) by using the evaluation value calculated in steps S302 and S303.

More specifically, the CPU 101 acquires the evaluation values B1 and B2, which has been calculated in step S302, and C1 and C2, which has been calculated in step S303, from the RAM 102. Furthermore, the CPU 101 determines whether a difference value calculated by a term (C2−B1) is greater than a difference value calculated by a term (C1−B2).

If it is determined that a difference value calculated by a term (C2−B1) is greater than a difference value calculated by a term (C1−B2) (YES in step S304), then the processing advances to step S305. On the other hand, if it is determined that a difference value calculated by a term (C1−B2) is greater than a difference value calculated by a term (C2−B1) (NO in step S304), then the processing advances to step S306.

In step S305, the CPU 101 executes processing for generating transparent image data. More specifically, the CPU 101 generates transparent image data for forming a transparent image on the area on which an image can be formed other than the area acquired in step S203.

In step S306, the CPU 101 executes processing for generating transparent image data. More specifically, the CPU 101 generates transparent image data for forming a transparent image on the area acquired in step S203.

With the above-described configuration, the present exemplary embodiment can raise the degree of glossiness of the area designated by the user regardless of the density of a color image independently of the distribution of density of the color image formed on the sheet.

In the above-described first and second exemplary embodiments of the present invention, the CPU 101 of the MFP controls processing for generating transparent image data. However, it is not always necessary to generate transparent image data with an image forming apparatus of an image forming system. Accordingly, in a third exemplary embodiment of the present invention, transparent image data is generated outside the image forming apparatus.

Figure 16A:
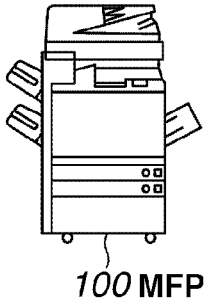
FIGS. 16A through 16C each illustrate an exemplary configuration of an image forming system according to an exemplary embodiment of the present invention.
Figure 16B:
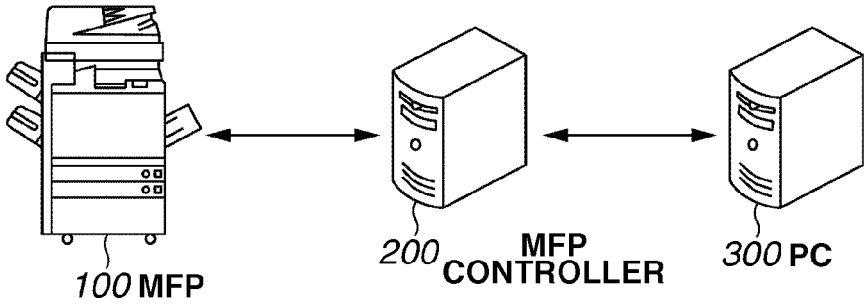
Figure 16C:
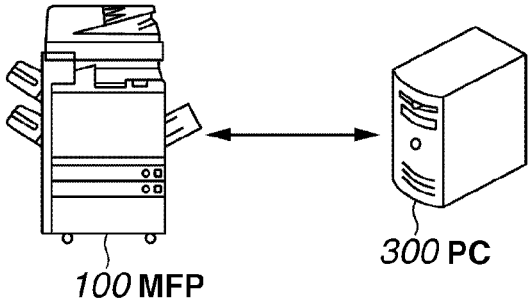

FIGS. 16A through 16C illustrate an exemplary configuration of an image forming system according to the present exemplary embodiment. Referring to FIG. 16A, the image forming system includes an MFP 100 only. In the present exemplary embodiment, the image forming system can also have a configuration illustrated in FIG. 16B or 16C.

Referring to FIG. 16B, the image forming system includes an MFP 100, an MFP controller 200, and a PC 300. In the example illustrated in FIG. 16C, the image forming system includes an MFP 100 and a PC 300.

Now, an exemplary hardware configuration of the PC 300 and the MFP controller 200 will be described in detail below. The PC 300 of the image forming system is an example of an external terminal capable of transmitting a print command to the MFP 100. Accordingly, a terminal capable of transmitting a print command and different from the PC 300 can be used instead of the PC 300. More specifically, it is also useful if a workstation (WS) or a mobile terminal, such as a personal digital assistant (PDA), is used instead of the PC 300.

In the above-described first and second exemplary embodiments, the color image and the transparent image are formed on the sheet by the MFP 100 having the configuration illustrated in FIG. 2. However, the present invention is not limited to this. More specifically, an image forming apparatus having color image forming stations and a transparent image forming station illustrated in FIG. 17 can be used as the MFP 100.

Figure 17:
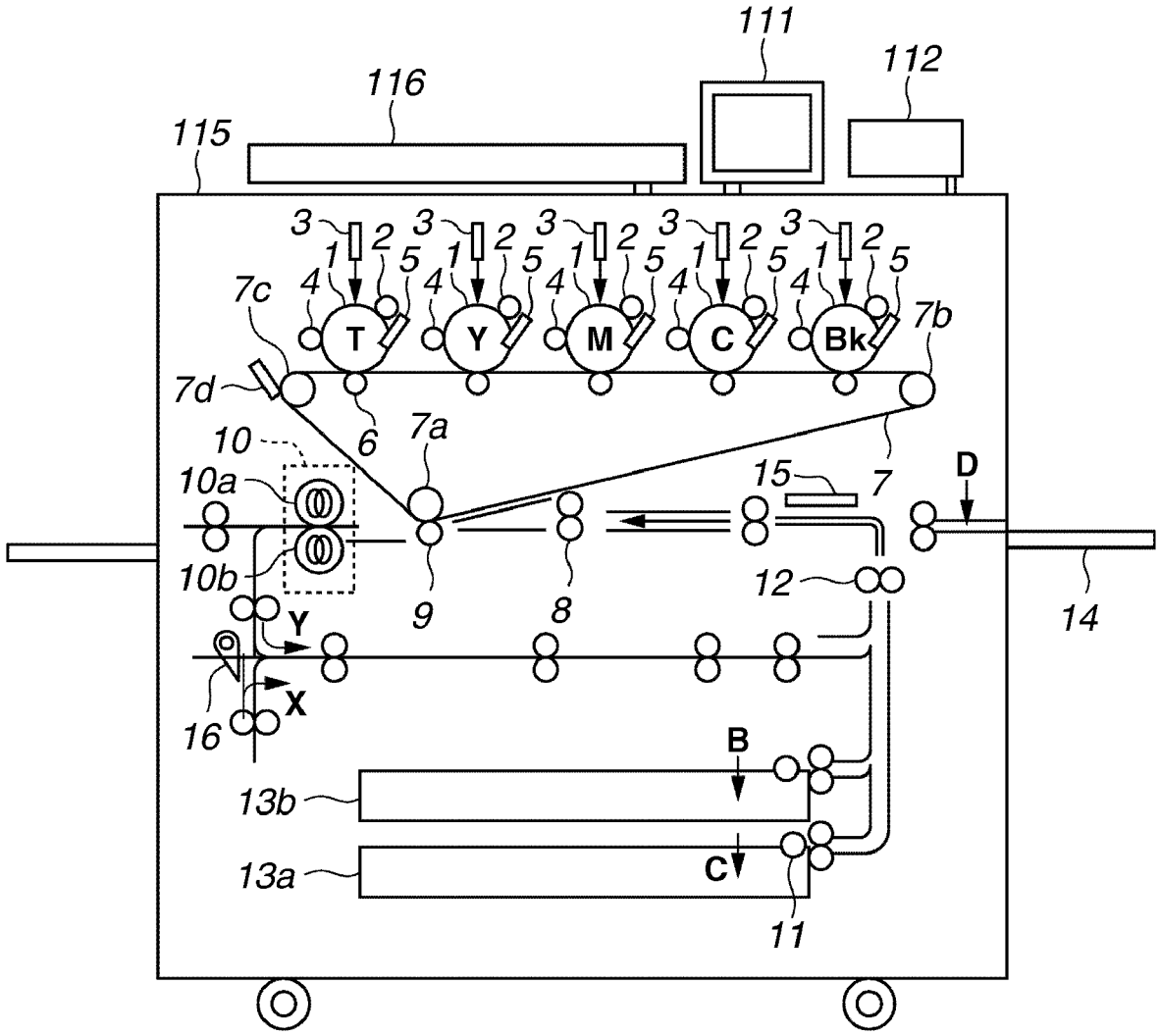
FIG. 17 illustrates an example of an MFP according to an exemplary embodiment of the present invention.

In the example illustrated in FIG. 17, the MFP 100 transfers and fixes color toners on the sheet. After the color toners are fixed thereon, the sheet is conveyed into a secondary transfer unit again by a flapper 16.

After being conveyed to the secondary transfer unit, the transparent toner is transferred on the sheet so as to cover the fixed color toners. A fixing device 10, which is an example of a first fixing unit, fixes the color toners on the sheet. The fixing device 10, which is an example of a second fixing unit, also fixes the transparent toner on the sheet. More specifically, in the MFP 100 illustrated in FIG. 17, the functions of the first and the second fixing units are provided on the same unit.

The configuration of the image forming apparatus according to the present exemplary embodiment is not limited to this. That is, it is also useful if any other image forming apparatus capable of transferring, forming, and fixing a transparent toner on the sheet on which color toners have been fixed is used as the MFP 100.

More specifically, it is also useful if the MFP 100 illustrated in FIG. 17 forms and fixes a transparent image on the sheet having the color images fixed thereon in the following manner. In this case, the MFP 100, at first, forms and fixes color images on the sheet. The sheet having the color images fixed thereon is then discharged outside the MFP 100. The MFP 100 displays a message that prompts the user to set the sheet having the color images fixed thereon onto a manual feed tray 14. Then, the MFP 100 forms and fixes a transparent image on the sheet set on the manual feed tray 14.

By executing the above-described control of the image forming apparatus, the present exemplary embodiment can form and fix a transparent image so as to cover the color images fixed on the sheet.

Figure 20:
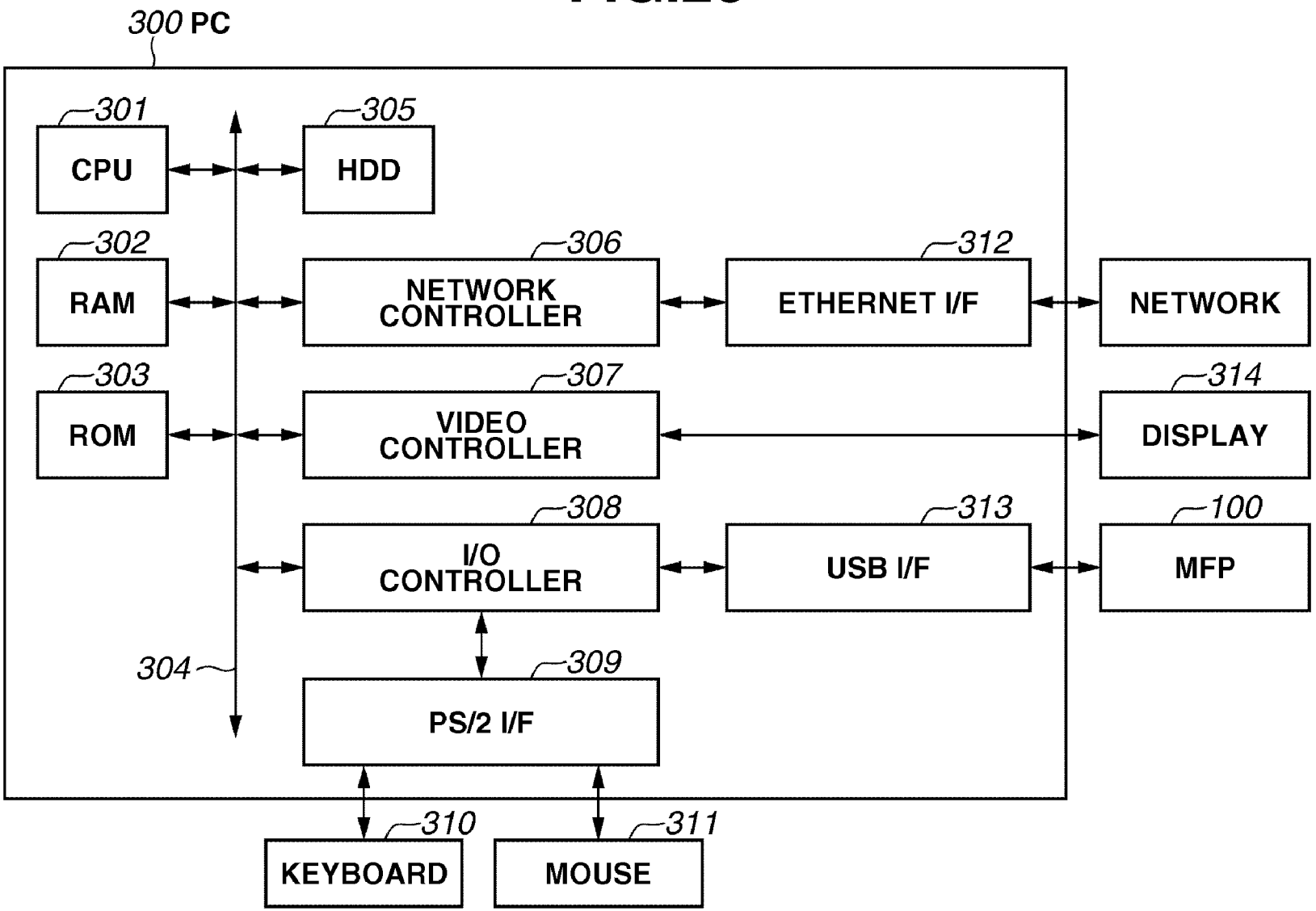
FIG. 20 illustrates an exemplary outline configuration of a personal computer (PC) according to an exemplary embodiment of the present invention.

FIG. 20 illustrates an exemplary hardware configuration of the PC 300, which is an example the information processing apparatus according to the present exemplary embodiment. Now, an exemplary hardware configuration of the PC 300 will be described in detail below.

A CPU 301, a RAM 302, a ROM 303, an HDD 305, a network controller 306, a video controller 307, and an I/O controller 308 are in communication with one another via a bus 304. The units connected to the bus 304 can execute data communication via the bus 304.

The CPU 301 loads and executes a program stored on the ROM 303 on the RAM 302. The ROM 303 records the program executed by the CPU 301. The RAM 302 is used when the CPU 301 executes the program.

In addition, the CPU 301 transmits a control command to the HDD 305, the network controller 306, the video controller 307, and the I/O controller 308 via the bus 304. Furthermore, the CPU 301 receives data, such as a signal including status information or image data, from the HDD 305, the network controller 306, the video controller 307, and the state from the I/O controller 308 via the bus 304.

With the above-described configuration, the CPU 301 according to the present exemplary embodiment can control each of the above-described units and components of the PC 300.

The HDD 305 records various files used on the PC 300. The network controller 306 is a dedicated circuit for executing data communication with an external apparatus. More specifically, the network controller 306 modulates the signal transmitted from the CPU 301. Furthermore, the CPU 301 converts the signal into multivalued signal compliant with the IEEE803.2 standard. Moreover, the CPU 301 transmits the converted signal to the network via an Ethernet I/F 312.

In addition, the network controller 306 demodulates the multivalued signal received from the network via the Ethernet I/F 312 and transmits the demodulated signal to the CPU 301.

The communication path for the communication between the PC 300 and the MFP 100 or the MFP controller 200 is not limited to a local area network (LAN). More specifically, it is also useful if the PC 300 executes data communication with the MFP 100 or the MFP controller 200 via the Internet.

The I/O controller 308 converts a signal transmitted from the CPU 301 into a signal compliant with the standard applied on each interface. Furthermore, the I/O controller 308 transmits the converted signal having an appropriate format to an apparatus connected to the image forming system via a USB I/F 313 or a PS/2 I/F 309 of the PC 300. In addition, the I/O controller 308 converts a signal received via the USB I/F 313 or the PS/2 I/F 309 and transmits the converted signal to the CPU 301. Accordingly, the PC 300 can execute data communication with the MFP 100 via the USB I/F 313.

In addition, the PC 300 can acquire an input via an input device, such as a keyboard 310 or a mouse 311, via the PS/2 I/F 309. The video controller 307 converts image data into an image signal of a format with which the image data can be displayed on the display 314 according to a drawing command received from the CPU 301. With the above-described configuration, the CPU 301 can display a screen on the display 314.

In the present exemplary embodiment, the CPU 301 controls the above-described hardware of the PC 300 based on an operating system (OS). Accordingly, the user can execute a desired operation on the PC 300 without becoming particularly aware of the hardware of by operating a graphic user interface (GUI). Thus, the user can transmit a print command to an MFP located outside the image forming system by using an application program executed on the OS.

In transmitting the print command to the MFP, different control methods are used according to the model type of the MFP. Accordingly, the PC generates a control command according to the type of the MFP by using a driver program compliant with the model type of the MFP.

The driver program is built in the OS and thus is capable of generating a control command compliant with the configuration of a peripheral device connected to the image forming system.

Figure 19:
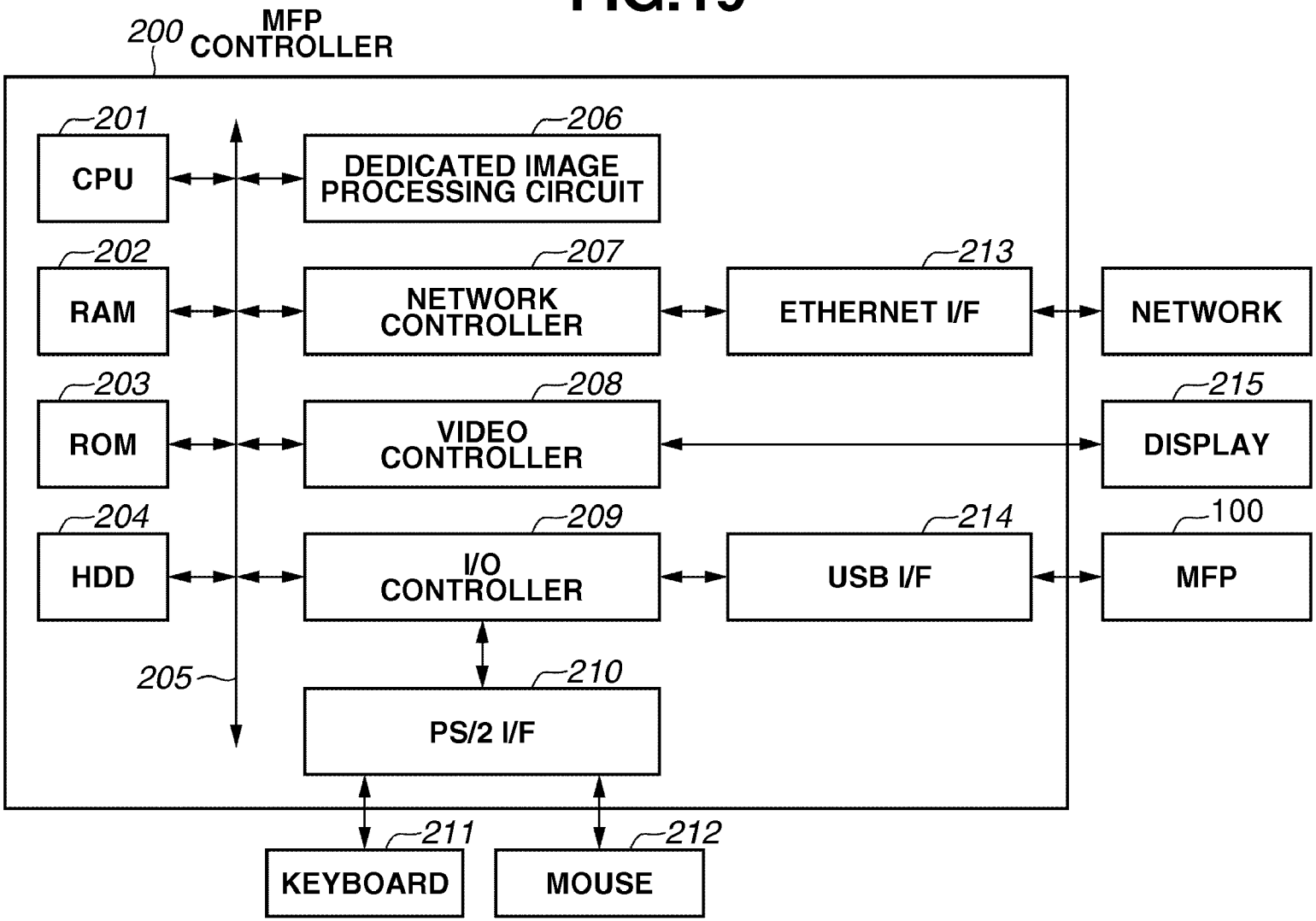
FIG. 19 illustrates an exemplary outline configuration of an MFP controller according to an exemplary embodiment of the present invention.

FIG. 19 illustrates an exemplary hardware configuration of the MFP controller 200, which is capable of converting PDL data into image data. Now, an exemplary hardware configuration of the MFP controller 200 will be described in detail below.

The MFP controller 200 of the image forming system converts PDL data received from the PC 300 into image data that the MFP 100 uses in printing. In the following description, processing for converting PDL data into image data will be simply referred to as RIP.

A CPU 201, a RAM 202, a ROM 203, a dedicated image processing circuit 204, an HDD 206, a network controller 207, a video controller 208, and an I/O controller 209 are in communication with one another via a bus 205.

The CPU 201 loads and executes a program stored on the ROM 203 on the RAM 202 and executes. In addition, the CPU 201 transmits a control command to the HDD 206, the network controller 207, the video controller 208, and the I/O controller 209 via the bus 205. Furthermore, the CPU 201 receives data, such as a signal including status information or image data, from the HDD 206, the network controller 207, the video controller 208, and the state from the I/O controller 209 via the bus 205. With the above-described configuration, the CPU 201 can control the above-described units of the MFP controller 200.

The MFP controller 200 is connected to the PC 300 via an Ethernet I/F 213. In addition, the MFP controller 200 is also connected to the MFP 100 via the Ethernet I/F 213.

The network controller 207 modulates a signal transmitted from the CPU 201 and converts the received signal into a multivalued signal compliant with the IEEE803.2 standard. In addition, the network controller 207 transmits the converted signal to the network via the Ethernet I/F 213. Moreover, the network controller 207 demodulates a multivalued signal received from the network via the Ethernet I/F 213 and transmits the demodulated signal to the CPU 201.

The I/O controller 209 converts a signal transmitted from the CPU 201 into a signal compliant with the standard employed on each interface. Furthermore, the I/O controller 209 transmits the converted signal to an apparatus connected to the image forming system via a USB I/F 214 or a PS/2 I/F 210. In addition, the I/O controller 209 converts a signal received from the USB I/F 214 or the PS/2 I/F 210 and transmits the converted signal to the CPU 201. With the above-described configuration, the MFP controller 200 can communicate with the MFP 100 via the USB I/F 214.

Furthermore, the MFP controller 200 can acquire a signal input via an input device, such as a keyboard 211 or a mouse 212, via the PS/2 I/F 210. The video controller 208 converts image data into a signal having a format with which the signal can be displayed on a display 215 according to a drawing command received from the CPU 201 and transmits the converted signal to the display 215. Accordingly, the CPU 201 can display a screen on the display 215.

The MFP controller 200 receives PDL data transmitted from the PC 300 and executes RIP on the received PDL data. An arithmetic operation command used during the RIP includes routine loop processing. Accordingly, it is likely that the processing time is shorter if all arithmetic operation commands are processed by hardware optimized for processing an image processing command than that in the case of processing the same on the CPU 201.

Therefore, the MFP controller 200 executes RIP by sharing the processing with the CPU 201 and the dedicated image processing circuit 204. However, the present invention is not limited to this. More specifically, it is also useful if the RIP is executed on the CPU 201 only.

The dedicated image processing circuit 204 includes an application specific integrated circuit (ASIC). It is also useful if the dedicated image processing circuit 204 is implemented on reconfigurable hardware, such as a programmable logic device (PLD). The image data converted by the CPU 201 and the dedicated image processing circuit 204 in the above-described manner is transmitted to the MFP 100.

In the present exemplary embodiment, the generation of image data is executed by the MFP controller 200. However, it is also useful if the generation of image data is executed by the PC 300 or the MFP 100.

In the present exemplary embodiment, the image forming system includes a plurality of devices, such as the MFP 100, the MFP controller 200, and the PC 300. In the above-described first and second exemplary embodiments, the CPU 101 of the MFP 100 controls the image forming apparatus according to the processing flow of the above-described flow charts.

More specifically, if the image forming system includes the MFP 100 only as illustrated in FIG. 16A, the CPU 101 of the MFP 100 executes the control processing. On the other hand, if the image forming system includes a plurality of apparatuses, such as the MFP 100, the MFP controller 200, and the PC 300 as illustrated in FIG. 16B, it is not always necessary that the control processing is executed by the CPU 101 of the MFP 100.

In this case, it is also useful if the CPU 201 of the MFP controller 200 executes the control processing to raise the degree of glossiness of the area designated by the user to increase the glossiness thereof.

On the other hand, if the image forming system includes a plurality of apparatuses, such as the MFP 100 and the PC 300 as illustrated in FIG. 16C. In this case, it is also useful if the CPU 301 of the PC 300 executes the control processing for raising the glossiness of the area designated by the user to increase the glossiness thereof.

As described above, if the image forming system includes a plurality of apparatuses, it is not always necessary to execute the control processing on the CPU 101 of the MFP 100. Furthermore, in this case, it is not necessary that the CPU of the same apparatus executes all the processing. More specifically, it is also useful if a plurality of CPUs existing within the image forming system on the plurality of apparatuses sharedly execute the control processing. To paraphrase this, it is also useful if each step of the flow charts of FIGS. 9, 14, and 15 according to the first and second exemplary embodiments of the present invention is sharedly executed by the plurality of CPUs.

If the image forming system has the configuration illustrated in FIG. 16C, it is also useful if the CPU 301 of the PC 300 acquires the area whose degree of glossiness is to be increased while the CPU 101 of the MFP 100 acquires the information about the degree of glossiness of the sheet on which an image is to be formed.

As described above, the characteristic processing of the present invention can be executed by one information processing apparatus only or by an information processing system including a plurality of information processing apparatuses.

In addition, the program for causing the information processing apparatus or the information processing system to execute the characteristic processing can be remotely supplied to the information processing system or the information processing apparatus. Furthermore, it is also useful if the information processing apparatus included in the information processing system loads and executes codes of a program stored on an information processing apparatus installed outside the information processing system. More specifically, the program installed on the information processing apparatus itself can implement the above-described processing.

The format of the program is not limited to a specific format. More specifically, any program capable of executing the above-described processing can be used to implement each exemplary embodiment of the present invention.

As the recording medium (storage medium) for supplying such program code, a flexible disk, a hard disk, an optical disc, a magneto-optical disc, a magnetooptic disc (MO), a compact disc read only memory (CD-ROM), a compact disc recordable (CD-R), a compact disk rewritable (CD-RW), a magnetic tape, a nonvolatile memory card, a read only memory (ROM), and a digital versatile disc (DVD (DVD-recordable (DVD-R), DVD-rewritable (DVD-RW))), for example, can be used.

Furthermore, the program can be supplied to the image forming system by downloading the program by using the MFP 100 from the network via the Ethernet I/F 114 of the MFP 100. In addition, if the image forming system includes the MFP controller 200 and the PC 300, it is also useful if the program is supplied to the image forming system by using the MFP controller 200 and the PC 300 by downloading the program from a web page of a web site on the Internet via a web browser installed on the MFP controller 200 and the PC 300.

More specifically, it is also useful if the program itself or a compressed file having an automatic installation function including the program is downloaded from the web site onto a recording medium such as a hard disk.

The functions of the above embodiments can also be implemented by dividing the program code into a plurality of files and downloading each divided file from different web sites. That is, a World Wide Web (WWW) server for allowing a plurality of users to download the program file for implementing the functional processing configure the present invention.

In addition, the above program can also be supplied by distributing a storage medium such as a CD-ROM and the like which stores the program according to the present invention after an encryption thereof; by allowing the user who is qualified for a prescribed condition to download key information for decoding the encryption from the web site via the Internet; and by executing and installing in the computer the encrypted program code by using the key information.

In addition, the functions according to the embodiments described above can be implemented not only by executing the program code read by the computer, but also implemented by the processing in which an OS or the like carries out a part of or the whole of the actual processing based on an instruction given by the program code.

Further, in another aspect of the embodiment of the present invention, after the program code read from the storage medium is written in a memory provided in a function expansion board inserted in a computer or a function expansion unit connected to the computer, a CPU and the like provided in the function expansion board or the function expansion unit carries out a part of or the whole of the processing to implement the functions of the embodiments described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-020243 filed Jan. 30, 2009, which is hereby incorporated by reference herein in its entirety.

What is claimed is:

1. A control apparatus configured to control an image forming system including a color image forming unit configured to form a color image on a sheet, a transparent image forming unit configured to form a transparent image on the sheet, a first fixing unit configured to fix color images formed on the sheet, and a second fixing unit configured to fix the transparent image formed on the sheet, the control apparatus comprising:

an image data acquisition unit configured to acquire color image data corresponding to a color image to be formed on the sheet;

an area acquisition unit configured to acquire information about an area, the area being selected by a user so that glossiness of the area is relatively higher than that of other areas;

an execution unit configured to execute a first mode in which the transparent image forming unit forms a transparent image on the area of the sheet, the information about the area being acquired by the area acquisition unit, or a second mode in which the transparent image forming unit forms a transparent image on an area of the sheet where an image can be formed other than the area, the information of which is acquired by the area acquisition unit; and a control unit configured, if a density of the color image to be formed on the sheet is equal to or higher than a predetermined density, to control the execution unit to execute the second mode, and configured, if a density of the color image to be formed on the sheet is lower than a predetermined density, to control the execution unit to execute the first mode.

2. The control apparatus according to claim 1, further comprising a sheet information acquisition unit configured to acquire information about glossiness of a surface of the sheet on which an image is to be formed, wherein the control unit is configured, if the density of the color image to be formed on the sheet is equal to or higher than the predetermined density and if the glossiness of the surface of the sheet, the information about which is acquired by the sheet information acquisition unit, is smaller than a predetermined threshold value, to control the execution unit to execute the second mode, and wherein the control unit is configured, if the density of the color image to be formed on the sheet is lower than the predetermined density and if the glossiness of the surface of the sheet, the information about which is acquired by the sheet information acquisition unit, is lower than a predetermined threshold value, to control the execution unit to execute the first mode.

3. A control apparatus configured to control an image forming system including a color image forming unit configured to form a color image on a sheet, a transparent image forming unit configured to form a transparent image on the sheet, a first fixing unit configured to fix color images formed on the sheet, and a second fixing unit configured to fix the transparent image formed on the sheet, the control apparatus comprising:

a sheet information acquisition unit configured to acquire information about glossiness of a surface of the sheet on which an image is to be formed;

an area acquisition unit configured to acquire information about an area, the area being selected by a user so that glossiness of the area is relatively higher than that of other areas;

an execution unit configured to execute a first mode in which the transparent image forming unit forms a transparent image on the area of the sheet, the information about the area being acquired by the area acquisition unit, or a second mode in which the transparent image forming unit forms a transparent image on an area of the sheet where an image can be formed other than the area, the information of which is acquired by the area acquisition unit; and a control unit configured, if the glossiness of the surface of the sheet, the information about which is acquired by the sheet information acquisition unit, is equal to or higher than a predetermined threshold value, to control the execution unit to execute the second mode, and configured, if the glossiness of the surface of the sheet, the information about which is acquired by the sheet information acquisition unit, is lower than a predetermined threshold value, to control the execution unit to execute the first mode.

4. The control apparatus according to claim 3, further comprising:

an image data acquisition unit configured to acquire color image data corresponding to a color image to be formed on the sheet, wherein the control unit is configured, if the glossiness of the surface of the sheet, the information about which is acquired by the sheet information acquisition unit, is lower than a predetermined threshold value and if the density of the color image to be formed on the sheet is equal to or higher than a predetermined density, to control the execution unit to execute the second mode, and wherein the control unit is configured, if the glossiness of the surface of the sheet, the information about which is acquired by the sheet information acquisition unit, is lower than a predetermined threshold value and if the density of the color image to be formed on the sheet is lower than the predetermined density, to control the execution unit to execute the first mode.

5. A computer-readable storage medium storing instructions which, when executed by an information processing apparatus, cause the information processing apparatus to function as the control apparatus according to claim 1.

6. A computer-readable storage medium storing instructions which, when executed by an information processing system including a plurality of information processing apparatuses, cause each of the plurality of information processing apparatuses included in the information processing system to function as the control apparatus according to claim 1.

7. An image forming system comprising:

a color image forming unit configured to form a color image on a sheet;

a transparent image forming unit configured to form a transparent image on the sheet;

a first fixing unit configured to fix color images formed on the sheet; and a second fixing unit configured to fix the transparent image formed on the sheet; and the control apparatus according to claim 1.

* * * * *